US009637361B2

(12) United States Patent
Long et al.

(10) Patent No.: US 9,637,361 B2
(45) Date of Patent: May 2, 2017

(54) METHOD AND APPARATUS FOR RAISING A STRUCTURE

(71) Applicant: 2NDSTORYPLUS, LLC, Tualatin, OR (US)

(72) Inventors: William T. Long, Tualatin, OR (US); David E. Krueger, Mulino, OR (US); Ryan Evan Paddock, Milwaukie, OR (US)

(73) Assignee: 2NDSTORYPLUS, LLC, Tualatin, OR (US)

( * ) Notice: Subject to any disclaimer, the term of this patent is extended or adjusted under 35 U.S.C. 154(b) by 0 days.

(21) Appl. No.: 14/603,228

(22) Filed: Jan. 22, 2015

(65) Prior Publication Data

US 2015/0204091 A1 Jul. 23, 2015

Related U.S. Application Data

(60) Provisional application No. 61/930,401, filed on Jan. 22, 2014.

(51) Int. Cl.

| | |
|---|---|
| ***B66F 3/08*** | (2006.01) |
| ***E04G 23/02*** | (2006.01) |
| ***E04G 23/06*** | (2006.01) |
| ***E04B 1/35*** | (2006.01) |
| ***E04G 21/16*** | (2006.01) |

(52) U.S. Cl.

CPC ..... *B66F 3/08* (2013.01); *E04B 1/3522* (2013.01); *E04B 1/3527* (2013.01); *E04G 21/163* (2013.01); *E04G 23/0266* (2013.01); *E04G 23/065* (2013.01); *E04G 23/02* (2013.01)

(58) Field of Classification Search

CPC ..... E04H 12/342; E04H 12/344; E04H 12/34; E04H 12/18; E04H 1/1205; E04G 23/02; E04G 23/065; E04G 25/04; B66F 3/46; B66F 7/00; B66F 3/08

USPC ..... 52/125.2, 125.3, 125.6, 125.1, 122.1, 52/745.2, 745.03

See application file for complete search history.

(56) References Cited

U.S. PATENT DOCUMENTS 221,977 A * 11/1879 Donnelly ..... A41B 3/16 2/135

2,932,486 A 4/1960 Suderow (Continued)

FOREIGN PATENT DOCUMENTS

EP 0 835 703 A2 4/1998
EP 0 835 703 A3 1/1999

(Continued)

OTHER PUBLICATIONS

International Search Report and Written Opinion for PCT Application No. PCT/US2015/012504, Apr. 16, 2015, 13 pages, European Patent Office, Rijswijk, Netherland.

*Primary Examiner* — Phi A

(74) *Attorney, Agent, or Firm* — Marger Johnson

(57) ABSTRACT

A system and method for raising a structure, or part thereof, the system comprising vertical jack members connected and disposed about a rail system attached about the periphery of the structure. The vertical jack members comprise an outer sleeve and a slidable inner portion that is driven vertically by a jack screw and drive block. Extensible diagonal cross-braces stabilize the jack members and structure being raised.

10 Claims, 32 Drawing Sheets

(56) References Cited

U.S. PATENT DOCUMENTS

| | | | | | |
|---|---|---|---|---|---|
| 3,036,816 | A * | 5/1962 | Stubbs | E04B 1/3511 | 254/105 |
| 3,692,446 | A * | 9/1972 | Vanderklaauw | E04B 1/3511 | 264/34 |
| 3,828,513 | A * | 8/1974 | Vanderklaauw | E04B 1/3511 | 52/123.1 |
| 4,058,952 | A | 11/1977 | Donnelly | | |
| 4,251,974 | A * | 2/1981 | Vanderklaauw | E04B 1/3511 | 254/89 H |
| 4,467,585 | A | 8/1984 | Busby | | |
| 4,601,141 | A * | 7/1986 | Donnelly | E04B 1/3527 | 254/89 H |
| 4,980,999 | A * | 1/1991 | Terenzoni | E04B 1/3527 | 52/125.6 |
| 5,839,239 | A * | 11/1998 | Jang | E04B 1/3511 | 254/93 R |
| 8,544,238 | B2 * | 10/2013 | Larouche | E04B 1/3527 | 52/122.1 |
| 9,133,643 | B2 * | 9/2015 | Wasterval | E21B 15/00 | |
| 2004/0226258 | A1 * | 11/2004 | Zingerman | E04H 12/344 | 52/749.11 |

FOREIGN PATENT DOCUMENTS

| | | | |
|---|---|---|---|
| EP | 2 628 854 | A1 | 8/2013 |
| WO | 81/02175 | A1 | 8/1981 |
| WO | 2007/068064 | A1 | 6/2007 |

* cited by examiner

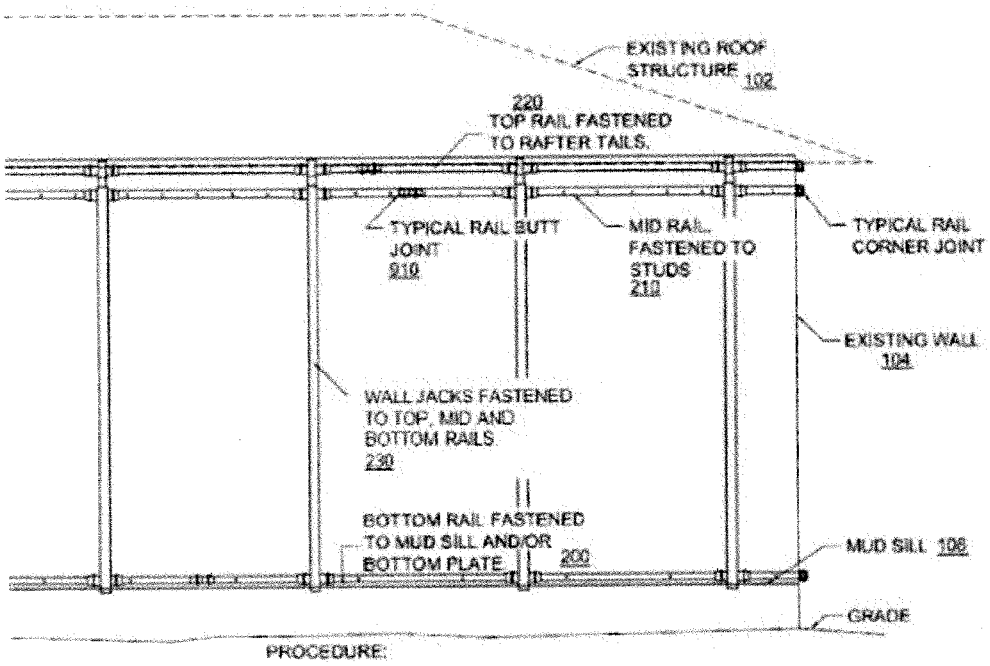
PROCEDURE:
1) MODIFY FOUNDATION STRUCTURE AND MAIN FLOOR FRAMING AS NEEDED PER PLANS TO SUPPORT NEW UPPER FLOOR LOADS.
2) REMOVE WALL CLADDING AS NEEDED TO PREPARE FOR RAIL INSTALLATION.
3) INSTALL TOP, MID AND BOTTOM RAILS AND ATTACHED PER PLANS.
4) INSTALL WALL JACKS AT A SPACING PER PLANS.
FIG. 9 STEP 1 – WALL JACK INSTALLATION

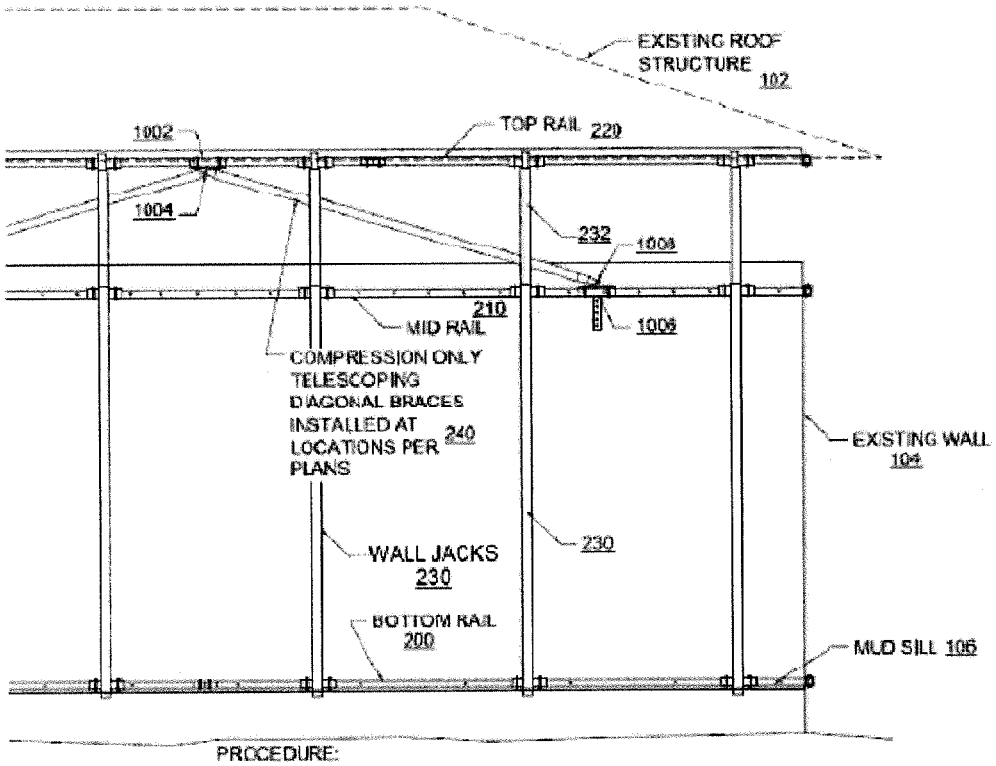
PROCEDURE:
1) DETACH RAFTERS FROM TOP PLATES.
2) LIFT ROOF STRUCTURE 2' +/-.
3) INSTALL LATERAL BRACING PER PLANS.
4) INSTALL FLOOR SYSTEM PER PLANS.
(NOT NECESSARY TO DO THIS AT STEP 2. COULD WAIT UNTIL STEP 3.)
FIG. 10 STEP 2 - INITIAL LIFT AND LATERAL BRACING

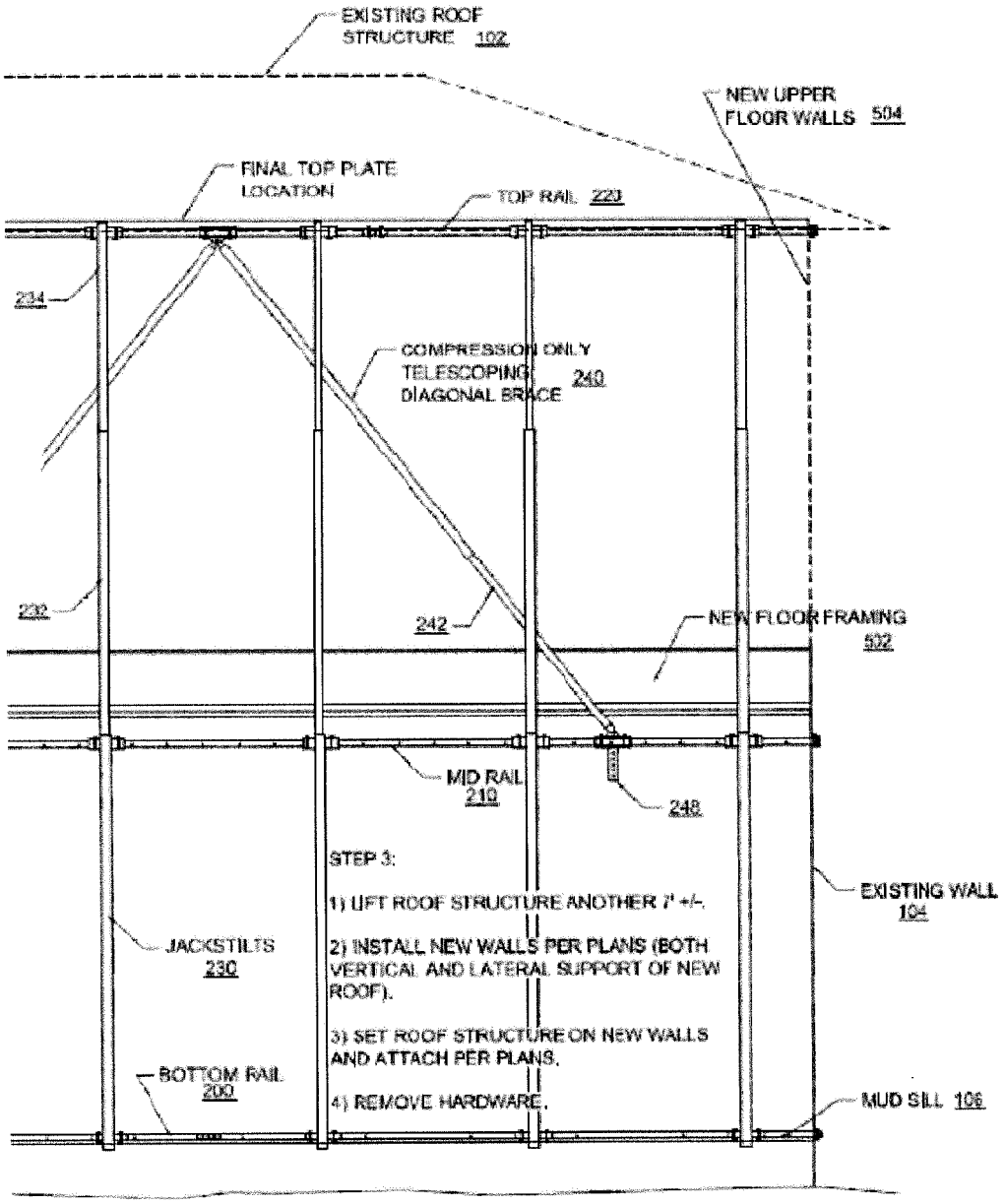
FIG. 11 STEP 3 - FINAL LIFT

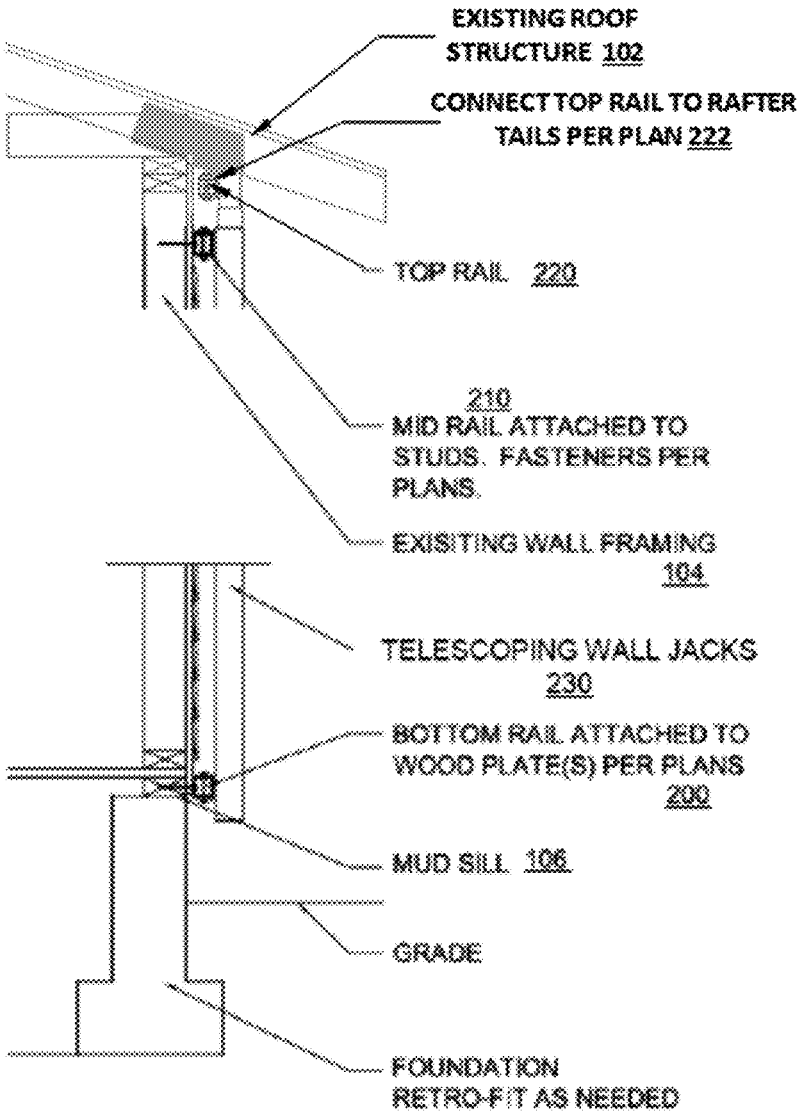
FIG. 12A WALL JACK SECTION

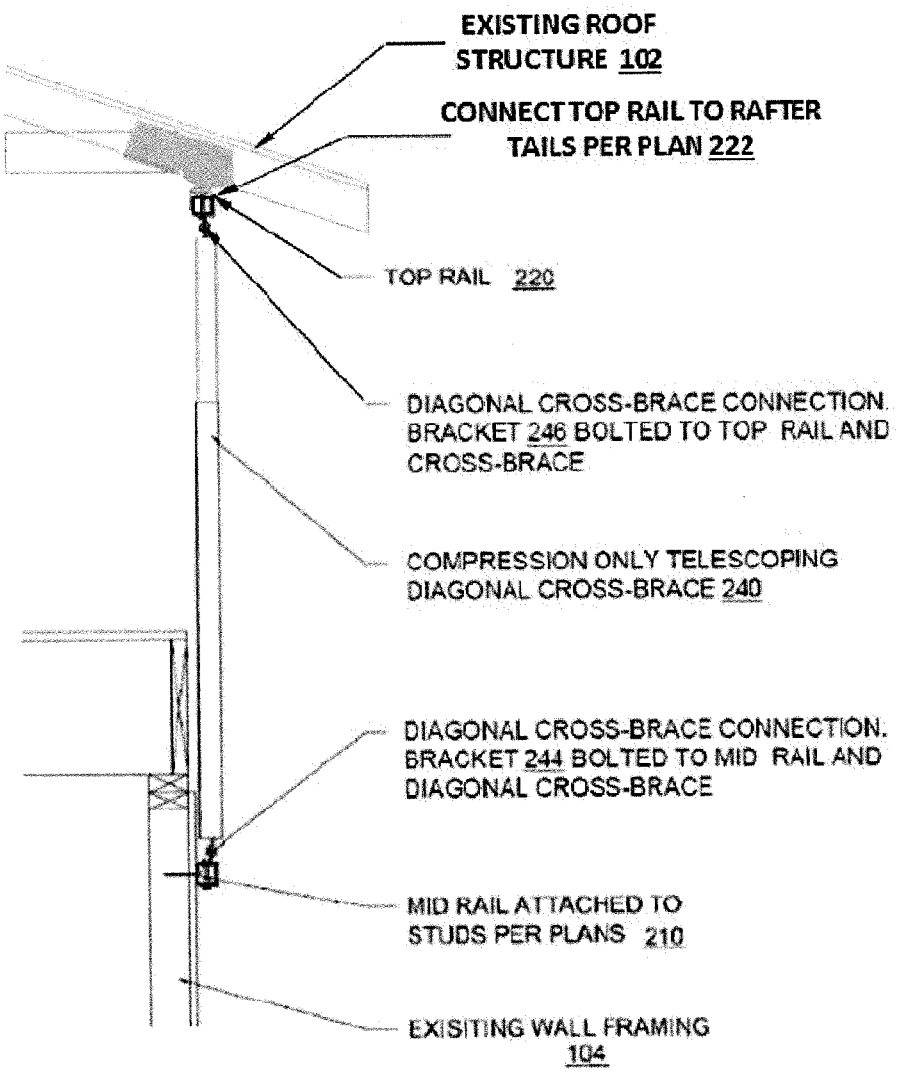
FIG. 13 DIAGONAL CROSS-BRACE

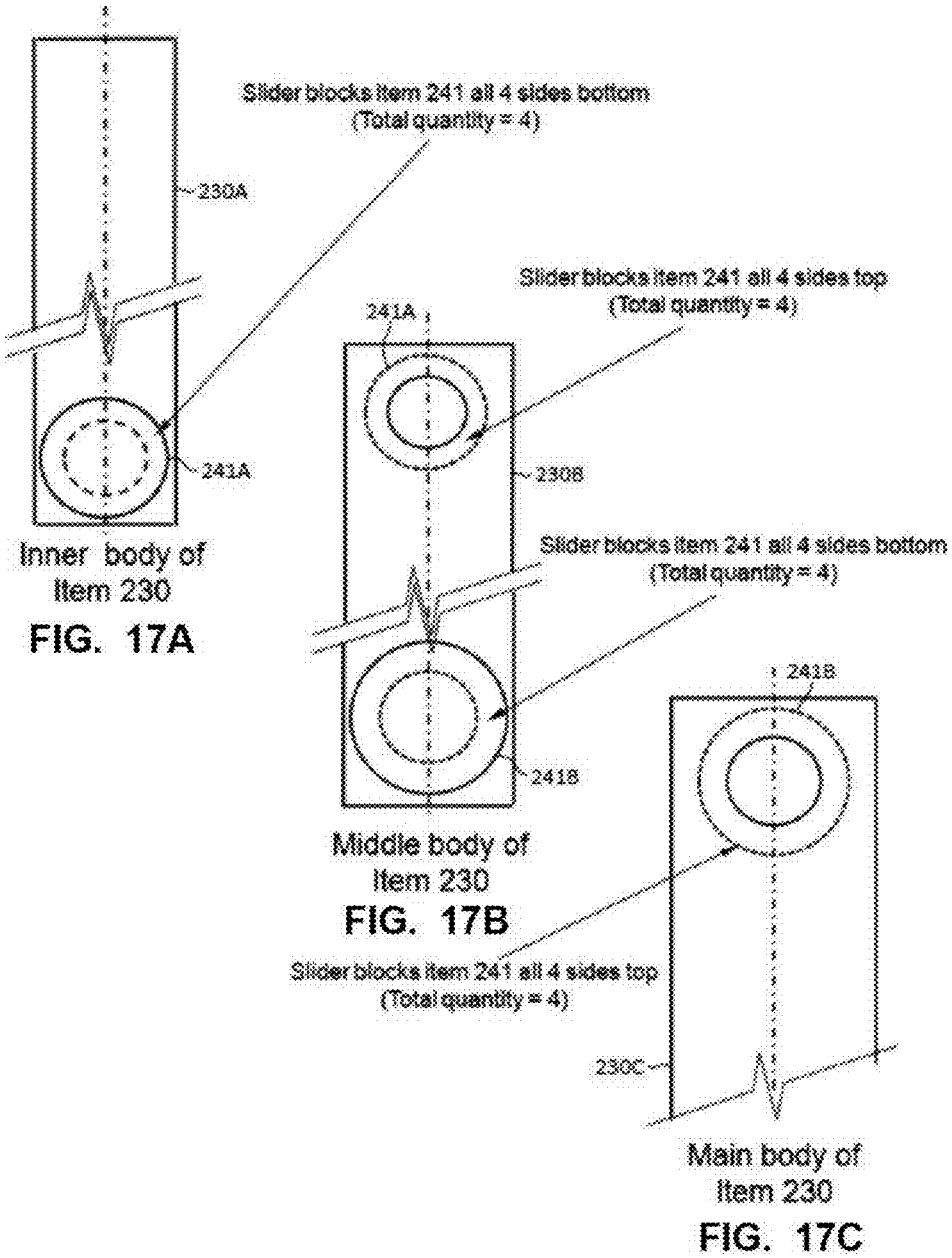
Non-metallic slider blocks

Slider blocks item 241 at bottom of inner body item 230

Slider blocks item 241 at top of middle body item 230

Slider blocks item 241 at bottom of middle body item 230

Slider blocks item 241 at top of main body item 230

Non-metallic slider blocks

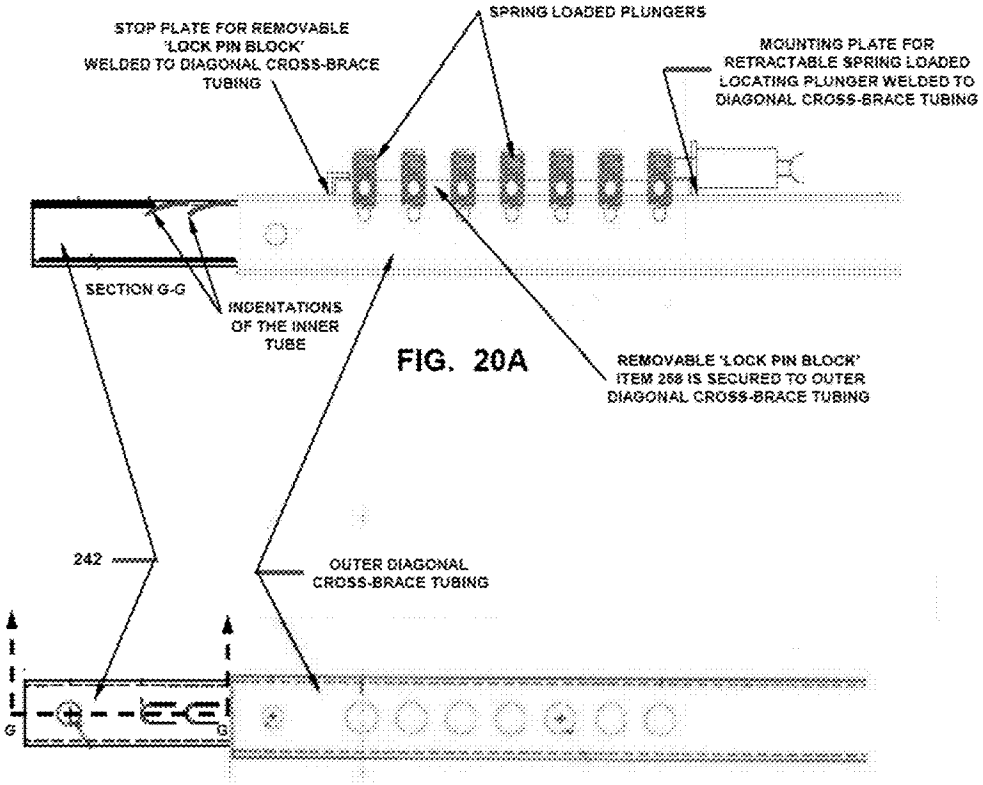
Lock Pins – diagonal cross-braces

METHOD AND APPARATUS FOR RAISING A STRUCTURE

CROSS REFERENCE TO RELATED APPLICATION

This application claims benefit of U.S. Provisional Patent Application No. 61/930,401, filed Jan. 22, 2014, which is hereby incorporated by reference in its entirety.

BACKGROUND

This invention pertains to construction and more particularly to expansion of existing houses and the like.

Many houses constructed during the post-World War II housing boom are single story dwellings. While the 'ranch style' house was popular then, now, with the price of land at a premium and consumers desiring larger, more spacious houses, multi-story dwellings are becoming the standard. Multi-story houses benefit not only the inhabitants but owners as well. The additional stories increase the size and the value of the house commensurately.

Financially it often is impractical to buy an existing single story house, demolish it and rebuild a new multi-story dwelling; rather, it would be ideal if the existing structure could be modified to increase its size. If the land size is large enough, it would be a simple matter to just build the house out farther but, many times, the house is already at a maximum size allowed per regulated footprint and setbacks for the land on which it resides.

Therefore, the only way to keep the existing structure and increase the size of the dwelling is to add additional levels. Converting a single story structure to a two-story effectively doubles the size of the living space and markedly increases the value of the structure. Traditionally, the addition of levels to an existing structure is an expensive and time consuming process that often yields minimum returns on investment. A new system and method for adding levels to an existing structure at a minimal cost and time would be most beneficial.

Currently, the process of adding an additional level to an existing structure requires the complete removal and destruction of the roof. The roof must be removed to allow the new level to be constructed and to allow access for the reinforcement of the existing structure. Reinforcement of the existing structure must often be done since the initial construction was not done in a manner to support the non-existent additional level(s). Once reinforced, the additional level(s) could be constructed on top of the existing structure. Finally, a new roof structure can be formed to complete the remodeling process. The removal and reconstruction of the roof structure adds additional time and cost to the process of adding the new level(s).

The invention enables a method for raising a structure with a jacking system for installation of a building element, which comprises one or more of vertical jack assemblies and a system to control the rate at which the structure can be elevated by the jack assemblies independently of each other jack assembly.

An object of this invention is to reduce the time and cost associated with the addition of new level(s) to an existing structure. The invention preserves the existing roof structure, creates a new system to rapidly construct the new level on the existing structure and utilizes pre-manufactured components to further decrease the cost and improve efficiency.

SUMMARY OF THE INVENTION

The invention is a system and method capable of lifting an entire structure, the roof of a structure or some portion of a structure. The invention uses a system of frames about the periphery of the structure to which jack members are mounted. The jack members extend to raise the desired structure or portion thereof. A control system is also provided to manage the lifting process; the control system monitors the lifting process and controls the rate of the extension of the jack members.

The lifting system and method disclosed has many advantages over the previous systems and methods. The invention does not require the use of specialized lifting beams to lift the structure or parts thereof. Additionally, since the installation of the system is within the footprint of the structure, there is minimal clearance required about the structure to be lifted.

When used on a roof structure, the system and method preserves the existing roof by lifting the roof vertically to install an additional story in the structure below. The vertical lifting also minimizes the potential for damage to the roof structure during the construction process since the roof is not moved laterally which can shift or damage the roof structure. Typically when a roof is removed to install an additional level in the structure, the roof requires reinforcement before the lifting process can begin, with the invention, the roof does not require such strengthening.

BRIEF DESCRIPTION OF DRAWINGS

FIG. 9 is a side elevation view of the wall jacking installation as initially installed on a side of a building structure and coupled to the roof structure.

FIG. 10 is a side elevation view of the wall jacking system of FIG. 9 following an initial lift of the roof structure and placement of lateral bracing.

FIG. 11 is a side elevation view of the wall jacking system of FIG. 10 following a final lift of the roof structure, extension of the lateral bracing and installation of new second story floor framing.

FIG. 12A is a cross-sectional view through the building wall of FIG. 9 showing details of connection of the jacking system to the sill plate and the roof structure.

FIG. 13 is a cross-sectional view through the building wall of FIG. 10 showing details of connection of the upper portion of the jacking system and lateral bracing to the upper portion of the existing wall and to the roof structure.

FIGS. 17A-17C are side views of non-metallic slider blocks in the vertical lifting elements 230.

FIG. 20A is a side view of the diagonal cross-brace outer tube and 'lock pin block' of FIGS. 11 and 13.

FIG. 20B is a top view of the diagonal cross-brace outer tube and 'lock pin block' of FIGS. 11 and 13.

DETAILED DESCRIPTION

Figure 1:
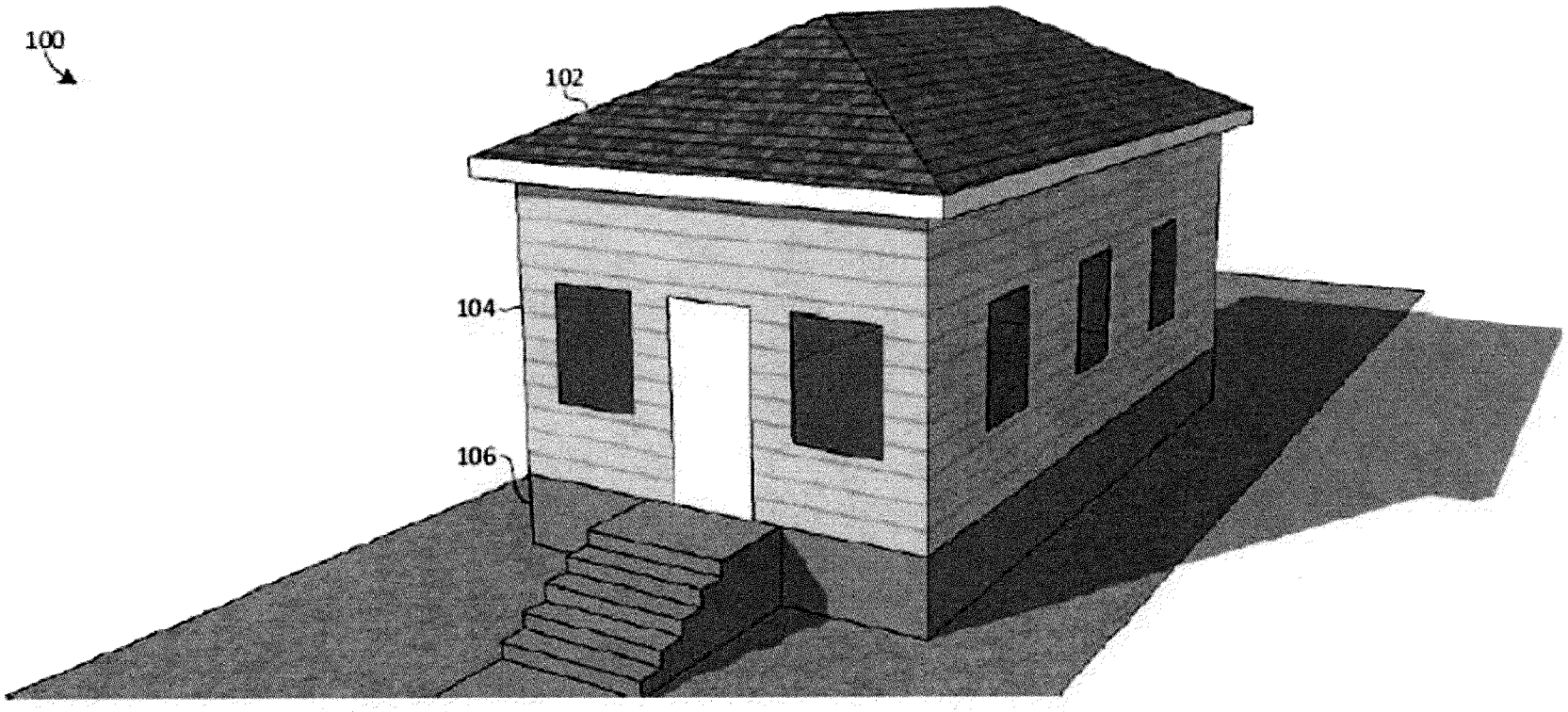
FIGS. 1-8 are conceptual drawings showing in perspective view the steps of enlarging a building structure such as a single-story house by raising the roof structure, adding floor structure and installing walls for a second story under the raised roof, using a jacking system according to an embodiment of the invention.

FIG. 1 shows a single story structure 100 to which an additional level(s) will be added. The roof 102 sits atop the main section 104 which is supported by the foundation sill plate 106.

Figure 2:
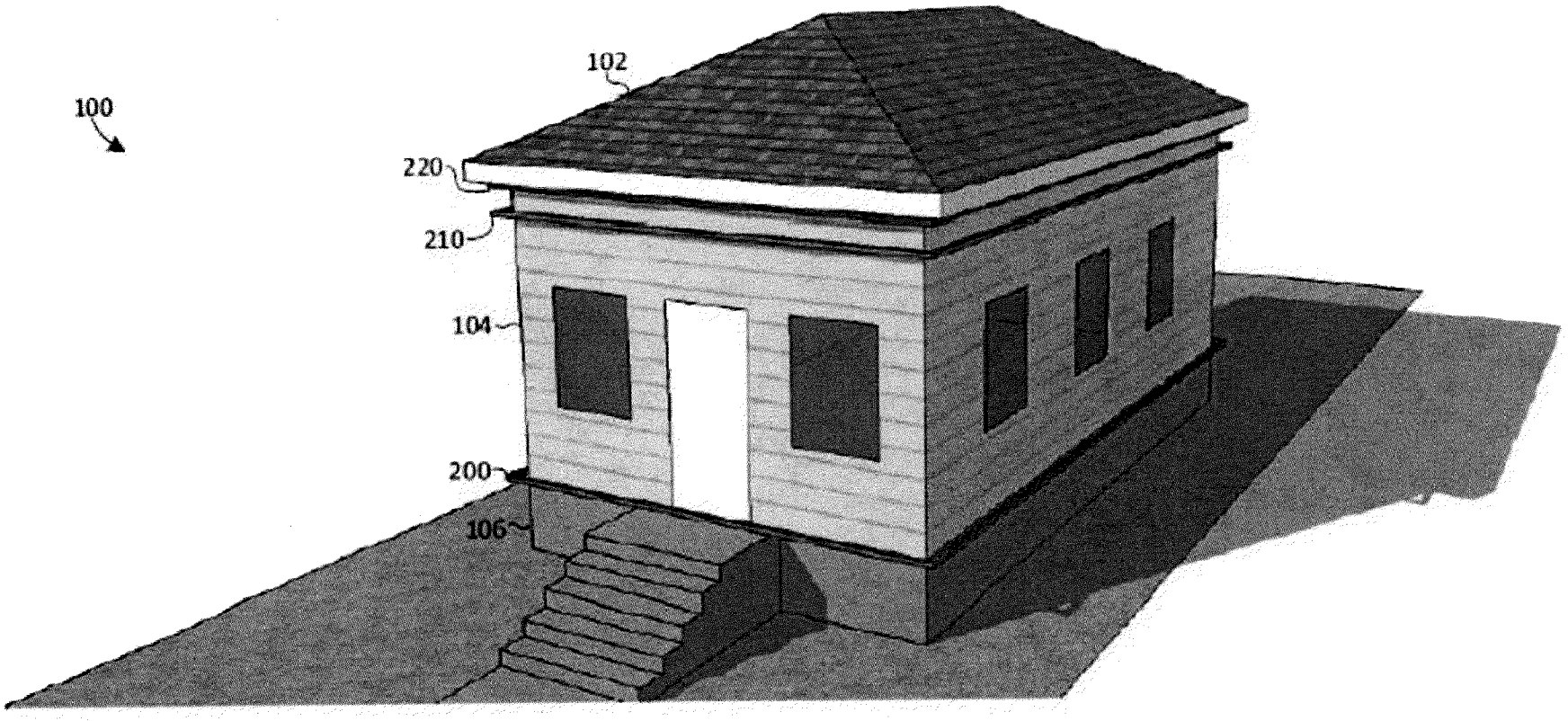

FIG. 2 shows the structure of FIG. 1 with the lifting rails 200, 210, and 220 installed around the periphery of the structure 100. The bottom lifting rail 200 is fastened to the sill plate 106 of the structure 100 and will serve as the base of the lifting system. The middle lifting rail 210 is attached about the upper periphery of the structure 100 and below the roof structure 102. Middle rail 210 is attached through the sides of the house and into the vertical studs of the main section 104. The upper lifting rail 220 is installed about the lower periphery of the roof 102 of the structure 100. The rail 220 is attached to the sill of the roof and/or attached to the ends of the rafters of the roof 102.

Figure 3:
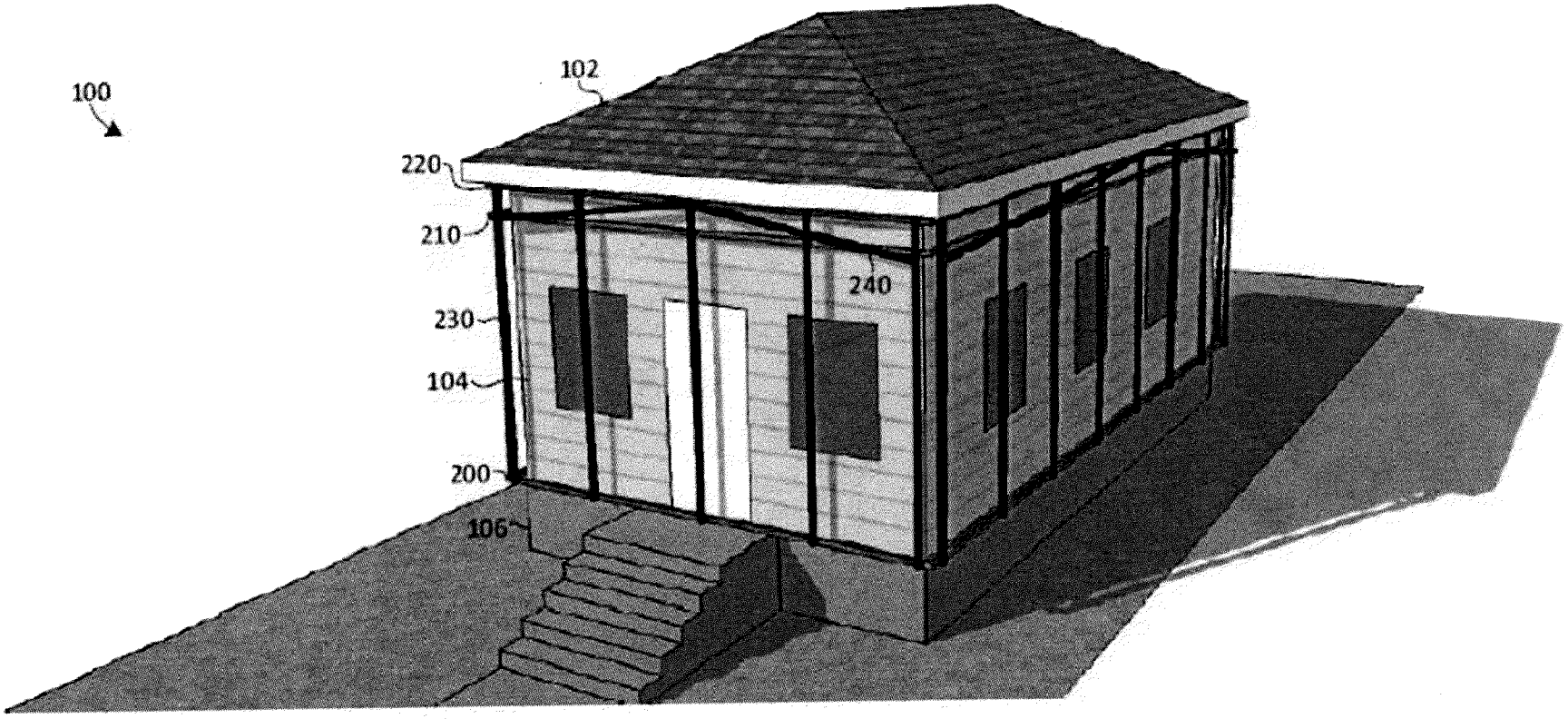

FIG. 3 shows the rails 200, 210 and 220 installed on the structure 100 and roof 102. The rails are interconnected by vertical lifting elements 230. The vertical lifting elements 230 will exert an upward force on upper rail 220 that will cause the roof structure 102 to lift up and away from the structure 100. In addition to the vertical lifting elements 230, extendible cross-braces 240 are installed between rails 210 and 220. The bottoms of cross-braces 240 are anchored to brackets affixed to the middle rail 210, the extendible end of the cross-braces 240 are attached to the rail 220 by a bracket, the upper and lower connection points allowing the end of the cross-brace to rotate about the connection points in the vertical plane of the structure.

Figure 4:
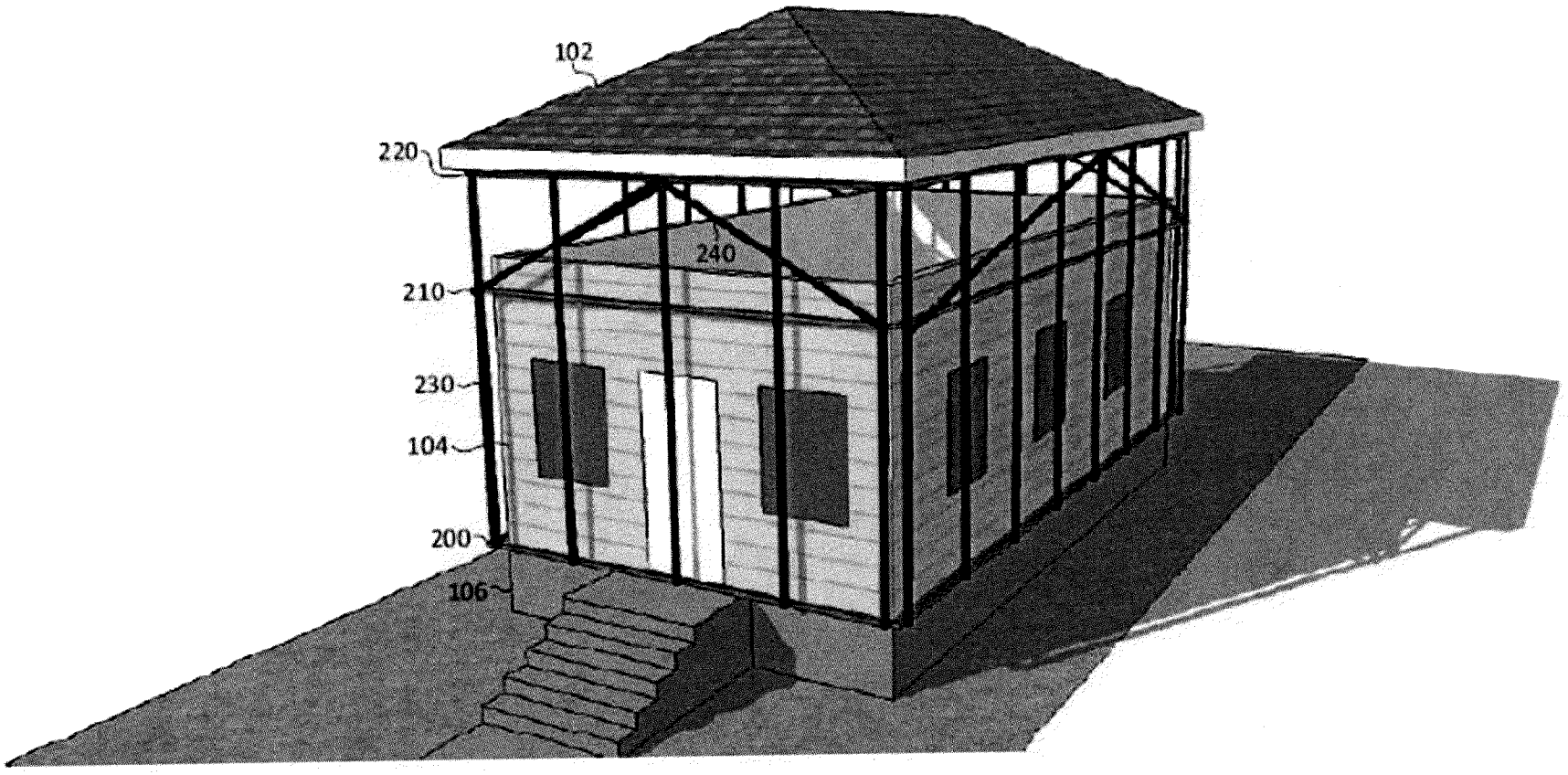

FIG. 4 illustrates the initial phase of the lifting process. The roof 102 is attached to the upper rail 220 that has been raised via the vertical lifting elements 230 to a first position an initial distance above the structure 100. As the roof structure 102 is raised, the ends of the cross-braces 240 extend and the ends rotate about their respective pin joints thereby providing lateral stability to the roof structure that has been separated from the perimeter walls of the house. The cross-braces 240 are allowed to automatically extend as the structure 102 is raised, but are prevented from retracting by an internal retaining element. The internal retaining element is a feature that allows the cross-braces to act as compression only members that will provide lateral stability of the existing roof and wall structure during lateral loads from construction, wind or seismic loads. The cross-braces are retractable by a user actuating a release mechanism that releases the internal retaining element thus allowing the cross-braces to retract automatically or by the user.

Figure 5:
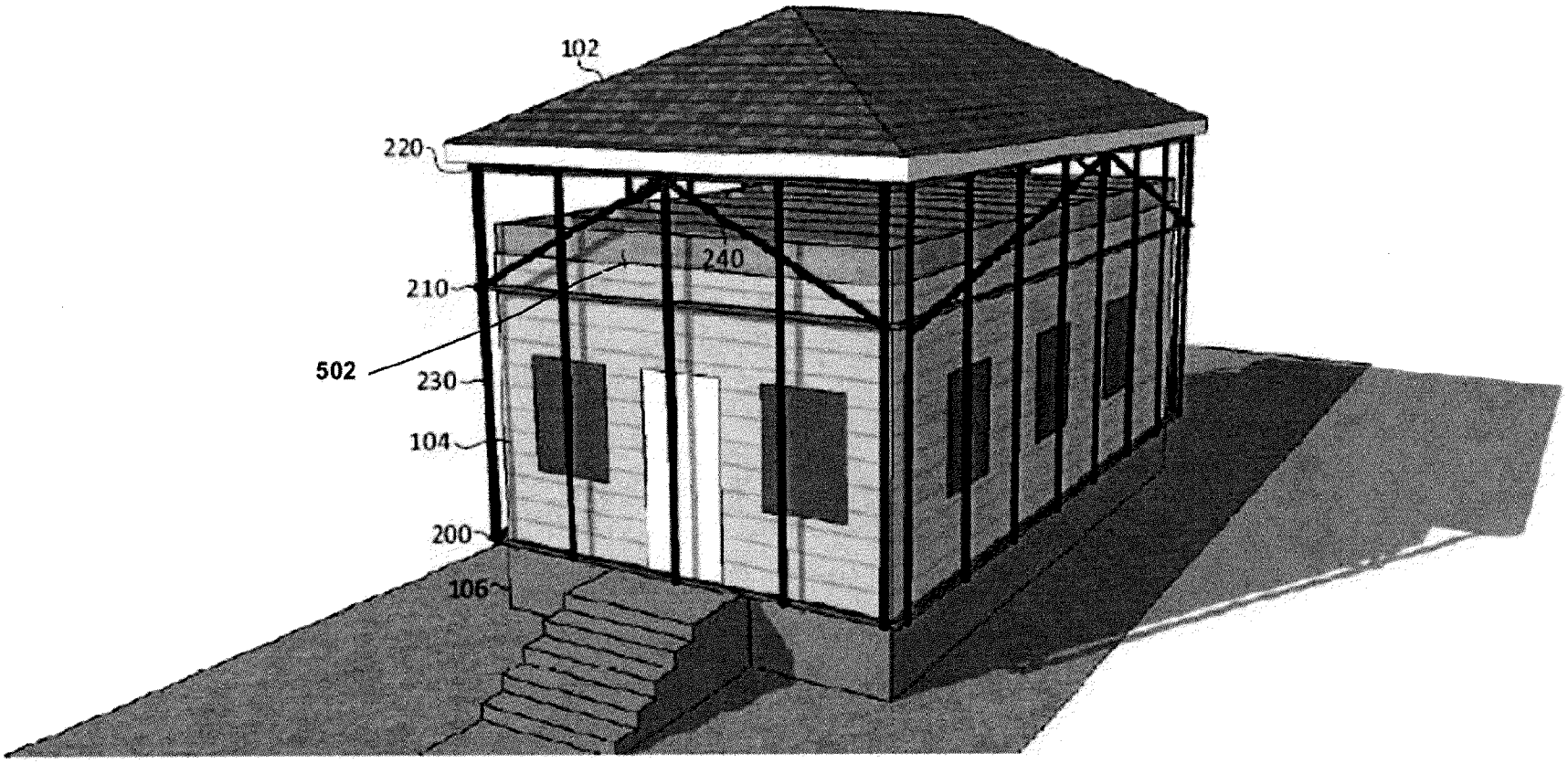

FIG. 5 shows the installation of the additional floor 502 atop the main section 104, which formerly supported the roof 102. The roof 102 is still at the initial position as lifted to in FIG. 4. This initial position is at a minimum height necessary to allow the installation of the floor 502.

Figure 6:
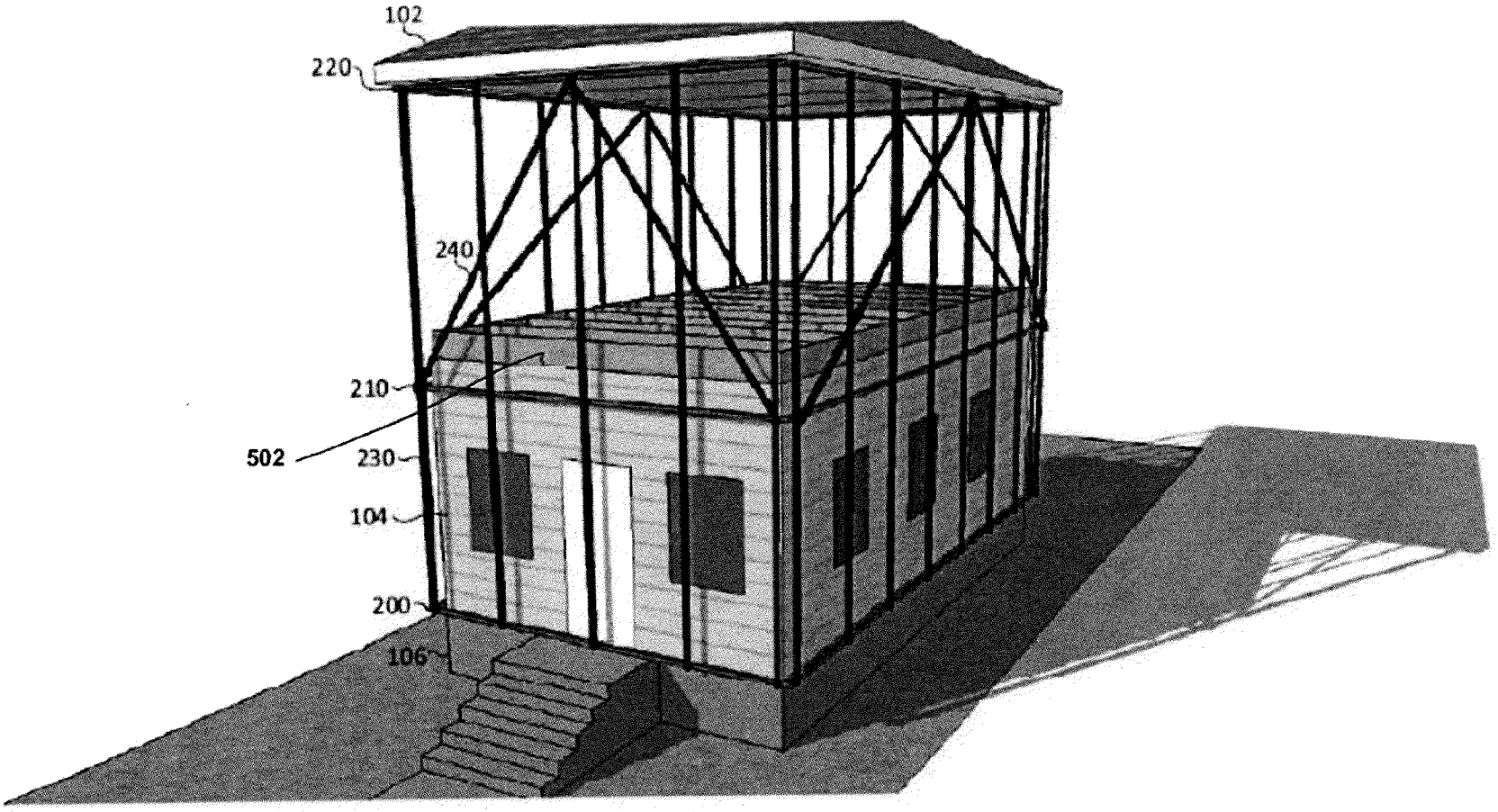

FIG. 6 illustrates the second phase of the lifting process. The roof 102, attached to rail 220, has been lifted higher than the final height of the new walls. Extendible cross-braces 240 have extended further to continue to provide lateral stability of the roof structure 102 and the existing walls 104.

Figure 7:
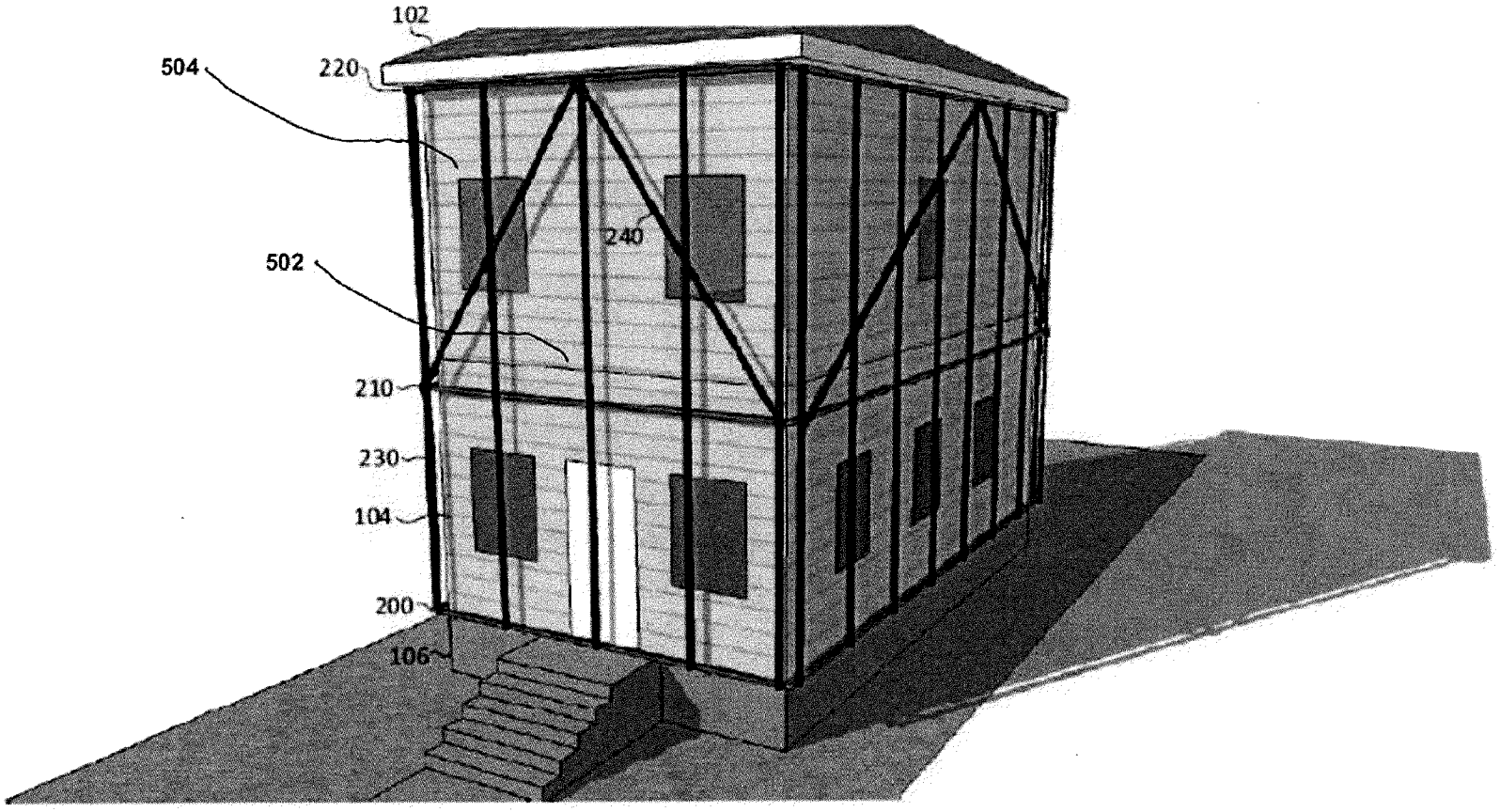

FIG. 7 shows the installation of the new walls 504, framing the periphery of the new level atop floor 502. Once the walls 504 are completed, the roof structure 102 is lowered down upon the new walls and reattached atop the new walls 504 to complete the two-story structure.

Figure 8:
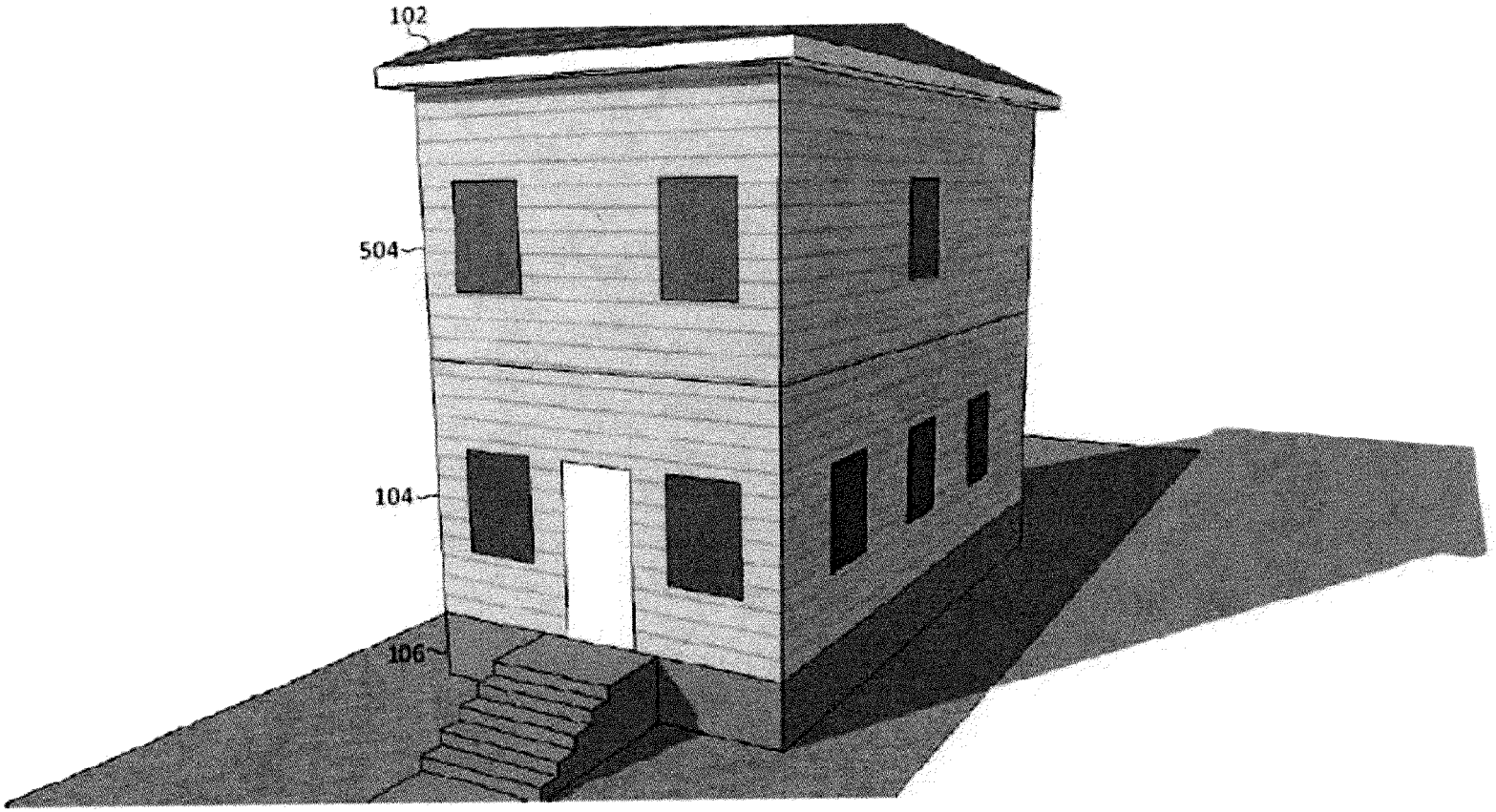

FIG. 8 shows the completed two-story structure with the lifting system and equipment removed from the building. The structure now has an additional story added to the pre-existing structure at minimal cost and time spent.

FIG. 9 is a schematic showing details of the lifting system attached to the structure 100. The bottom lifting rail 200 is attached to the sill plate 106. The bottom lifting rail 200 has holes 202 spaced regularly along the length of the rail 200. Multiple bottom rail elements 200 are interconnected to encircle the perimeter of the sill plate 106. The rail elements 200 are connected to one another using a butt joint 910. The rails 200 have holes 202A at each end. The butt joint 910 is inserted inside the end of a rail 200 and is locked in place by inserting retaining pins in the end holes 202A and through the holes on the butt joint. The end holes 202A are spaced to ensure that the spacing of the holes 202 is maintained across the interconnection at the butt joint 910. The interlocked elements of the lower rail 200 form a rigid framework that encircles the sill plate 106 and will act as the lower structure of the lifting system.

The top lifting rail 220 is attached to the roof structure 102. The top rail 220 is attached to the structure 102 via the ends of the roof rafters. Rail 220 encircles the roof structure 102 and will support the structure during the lifting process. The roof normally provides structural integrity to the structure 100. It acts as a diaphragm and holds the wall together and, in turn, the walls provide the rigid base on which the roof 102 sits. If separated from the structure 100, the roof structure 102 has a tendency to splay out and deform from the original shape, when this occurs, the roof is typically beyond salvage and must be rebuilt. Using this method and system, the rail 220 will maintain the form and size of the roof structure 102 when it is separated from the structure 100. This will ensure that the roof 102 can be reattached to the new walls once they are installed atop the main section of the existing structure. The reuse of the existing roof structure 102 is more cost and time efficient than the previously existing method in which the majority of the structure would have to be rebuilt or time consumingly reshaped to fit.

The middle lifting rail 210 is attached around the upper periphery of the main portion 104 of the structure 100. The middle rail 210 is attached to the studs of the house. Depending on the strength of the existing structure, the middle rail 210 can be attached to every stud or at some other regular or irregular interval. As with the bottom rail 200, middle rail 210 is made of individual elements that are interconnected using butt joints 910. Rails 210 also have the same hole pattern as that of rail 200 and 220, in this manner, the rail combination has spaced set of vertically arrayed hole patterns. Similar to the top rail 220, the middle rail 210 will maintain the dimensions of the main section 104 during the lifting process. With the roof removed, the walls are not braced for out of plane loads and would have a tendency to warp and move out of position, if not properly restrained in their position. This would necessitate a laborious process of "truing" or straightening the walls back to their original positions before the roof could be attached. The retention of the original dimensions and shape of the main section 104 during the lifting process allows the quick installation of a second story floor and additional walls atop and then the reattachment of the roof with minimal time and cost.

The vertical lifting elements 230 are attached at regular or irregular intervals around each side of the house and interconnect the rails 200, 210 and 220. Elements 230 are affixed to each rail using the holes 202 disposed on each rail. The system of holes on each rail allows for the quick attachment and removal of the lifting elements 230, additionally, the vertically-aligned pattern of holes makes it easy for someone installing the lifting elements 230 to space them properly and position them vertically around the periphery.

FIG. 10 shows the roof lifted to the initial position. The extendible, diagonal cross-braces 240 have been installed. The upper ends of the diagonal cross-braces may be attached at a common root point 1002 or at separate locations on the top lifting rail 220. The common root point 1002 may be a single bracket or separate brackets attached to the top rail 220, the cross brace ends are attached to the bracket(s) by pin joints 1004. The lower ends of the cross-braces 240 are affixed to the middle lifting rail 210 at points 1006 spaced equidistant from the root point 1002. The connection points 1006 are brackets similar to or the same as bracket 1002, and attach the lower end of the cross-brace 240 to the middle rail 210. The lower end of the cross-brace 240 attaches to the bracket 1006 at a pin joint 1008. The use of the pin joints allows the cross braces to rotate about the joint as the angle between the cross-brace 240 and middle rail 210 changes due to the lifting of the roof 102. As the roof is lifted, the cross-braces 240 will automatically extend and lock in position. In this manner, they provide lateral stability to the roof structure 102. The cross-braces 240 can utilize a ratcheting mechanism that allows them to be extended but will not allow them to be shortened until an external operation releases the ratchet mechanism and allows the extension pieces of the cross-braces to retract back into the main body tube of the cross-braces 240. The locking extension action can also be achieved by shaped frictional rings that allow for free extension but are locked into position upon application of back pressure. There exists many ways to achieve the locking extension mechanism and are well known to those skilled in the art. Each face of the structure would have at least one set of the cross braces installed.

As can be seen in FIG. 11, the vertical lifting elements 230 are telescoping. The main body 232 of the lifting element 230 is affixed at its top end to the middle lifting bar 210, while the bottom end is affixed to the lower lifting bar 200. The extension portion 234 is moveable within the main body 232 and connects to the top rail 220 and exerts the upward lifting force and motion to raise the roof structure 102 above the main structure 104. The extension portion 234 may be a single telescoping piece that moves within the main body 232, or may contain multiple telescoping pieces that nest within each other. Also seen in FIG. 11 are the extension elements 242 of the cross-braces 240. These are one-way extendible, meaning the extension elements will extend from the cross-braces 240 as the roof structure 102 is raised by the lifting elements 230, but will not automatically retract back within the cross-brace 240 unless an external manipulation is performed to release them. This provides lateral stability to the roof structure 102 and the existing walls 104.

Figure 12B:
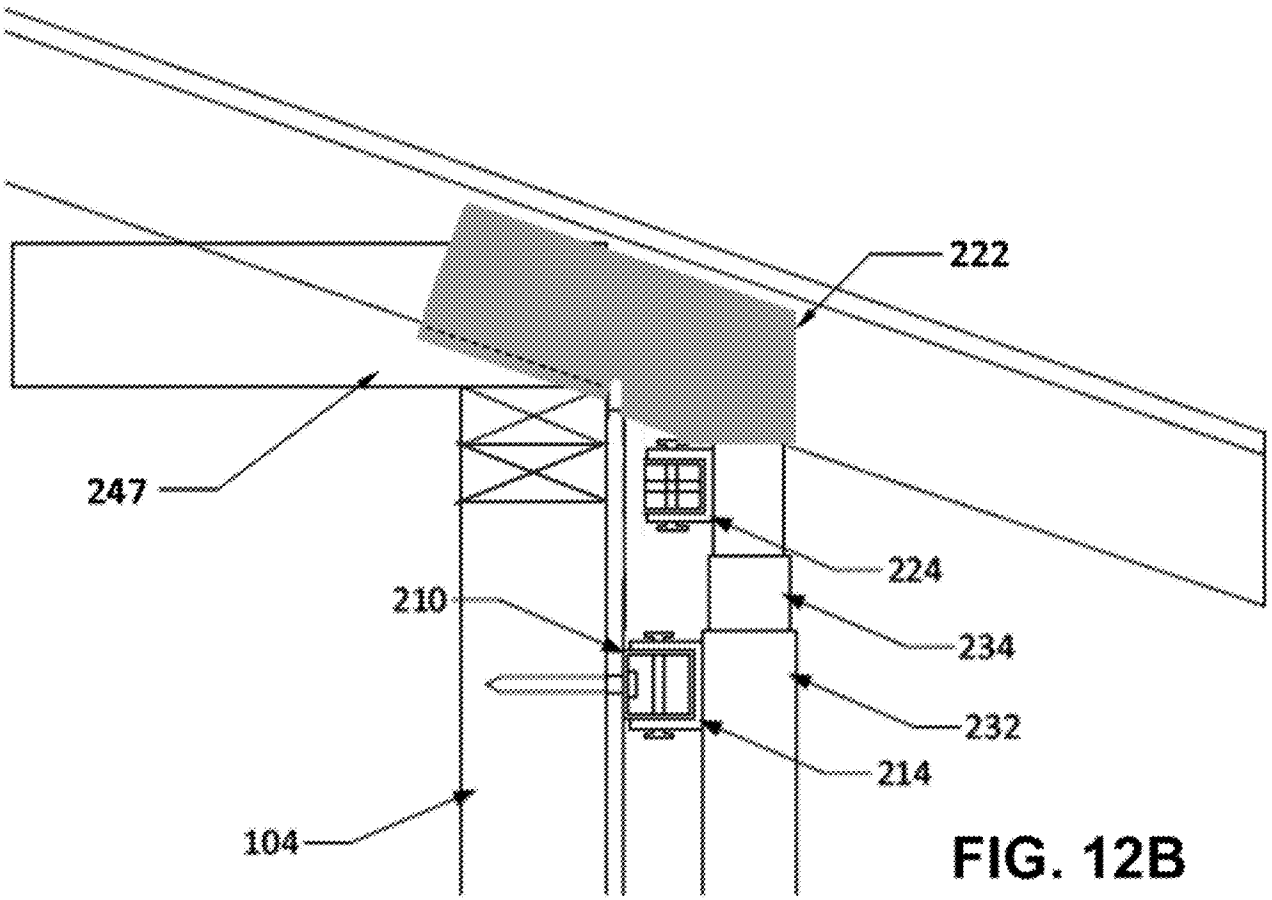
FIG. 12B is an enlarged view of the connection of FIG. 12A to the roof structure.

FIG. 12A is a detailed schematic view of the vertical lifting element 230 attached to the top, middle and bottom lifting rails 220, 210 and 200. The bottom lifting rail is attached to the sill plate via brackets 204 that are mounted to the sill plate 106 via mechanical fasteners. Before adding the additional level(s) to the structure, a study must be carried out to determine if the existing foundation and sill plate 106 is adequate to support the additional load. If the foundation and sill plate is found to not be adequate, it must be retrofitted or reinforced before the lifting system can be installed and used. The bracket used to mount the lower lifting rail to the sill plate can be integrated into the bracket that holds the vertical lifting element to the lower lifting bar 200 or it may be a separate piece. It is advantageous to use an integrated bracket that performs both functions as the added strength due to mounting of the bracket to the sill plate will help support the loads exerted on the vertical lifting element 230 as the roof load is elevated. The top of the lifting element main tube is attached to the middle rail 210. The middle rail 210 is attached to the studs of the structure 100 by a bracket 214 affixed by mechanical fasteners like the foundation bracket. Like the foundation bracket 204, the middle rail bracket 214 can be similar, attaching both the rail to the stud and the vertical lifting element to the rail. The top of the extension portion 234 of the vertical lifting element 230 is attached to the existing rafters or trusses with a bracket 222 attached to the top rail 220 and the perimeter roof structure 102 as better shown in FIG. 12B. At gable ends, the top rail 220 attaches to the end rafter or truss top chord just below the roof sheathing similar to the method that the mid rail 210 is attached to the exiting walls 104.

FIG. 13 is a detailed schematic view of a wall cross-section showing the detail of the diagonal cross-brace element 240. The bottom end of the element 240 is attached to the middle rail by a bracket 244. Extending from the bracket is a reinforced strap 248 that is further screwed to a wall stud of the building to provide a more secure and unmoving mounting point for the cross-brace 240. The upper end of the cross-brace 240 is attached to the top rail via a bracket 246.

Figure 14:
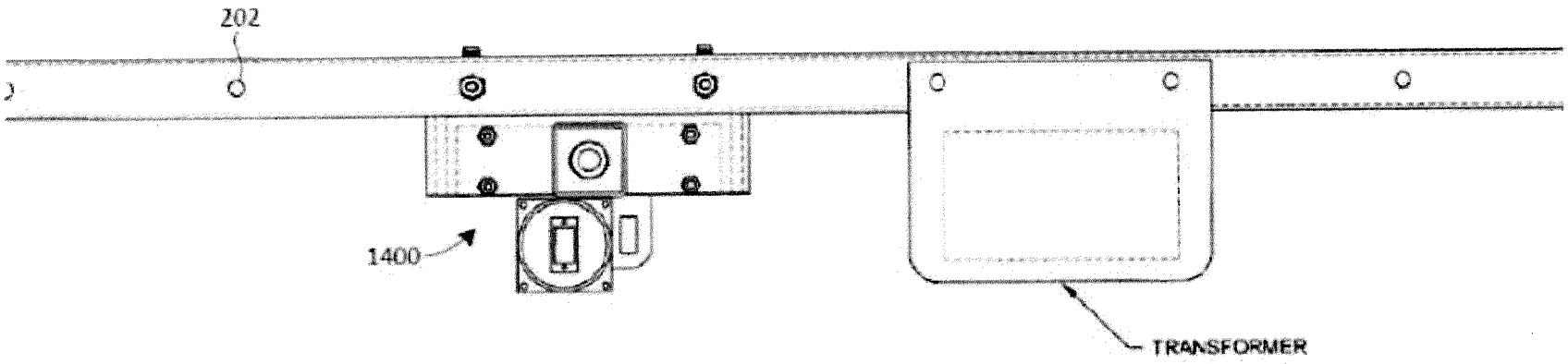
FIG. 14 is a top plan view of the drive element 1400 used on the bottom rail for driving one of the wall jacks in FIGS. 9-13.

FIG. 14 is a top view detailing the mounting of the vertical lifting element drive motor. The drive element 1400 is attached to the lower mounting rail and lower mounting rail bracket. A transformer supplying power to the drive element can be mounted on the lower rail at a nearby position using a set of the pre-drilled holes 202.

Figure 16:
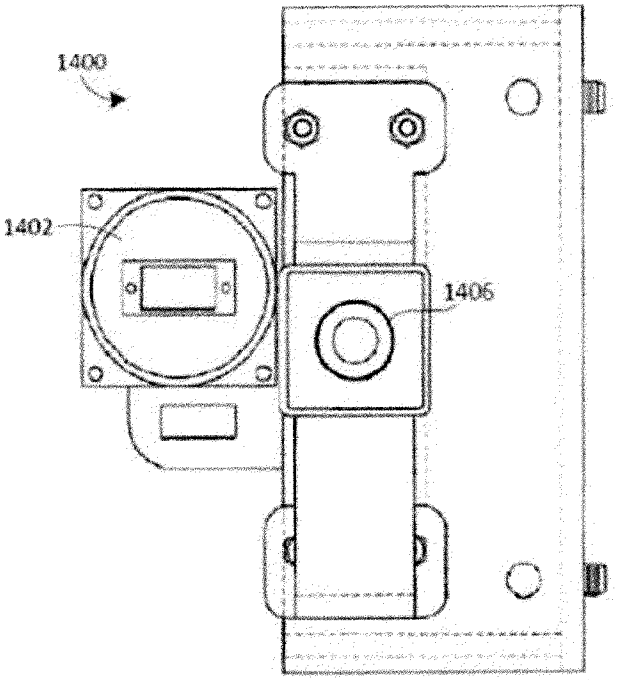
FIG. 16 is a cross-sectional view of the drive element 1400 of FIG. 15.
Figure 15:
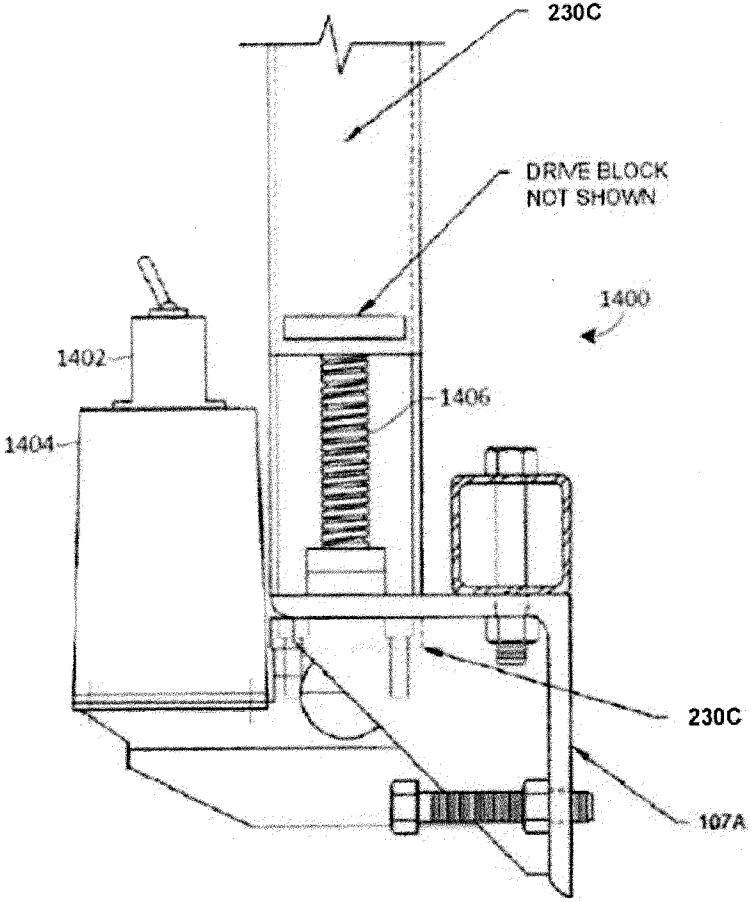
FIG. 15 is a side elevation view of the drive element 1400 of FIG. 14.
Figure 18A:
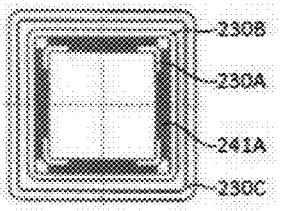
FIGS. 18A-18D are cross sectional views of non-metallic slider blocks in the vertical lifting elements 230 of FIGS. 17A-17C.
Figure 18B:
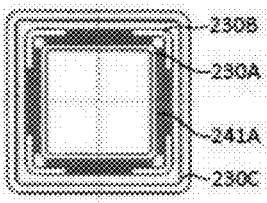
Figure 18C:
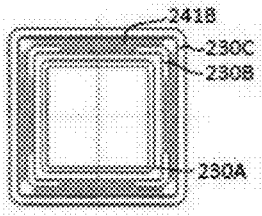
Figure 18D:
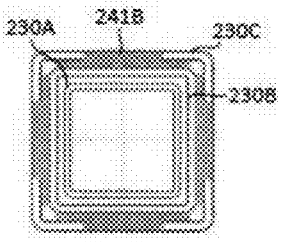

FIG. 15 shows a detailed side view of the drive element 1400 and bracket 107A and FIG. 16 shows a detailed top view of the drive element 1400 showing lifting rod 1406 in cross-section. The drive element 1400 has a drive motor 1402 that is attached to the drive gear box 1404 that drives a self-locking Acme threaded lifting rod 1406. Each vertical lifting element 230 has a drive block attached to the threaded lifting rod 1406 that elevates the extending portion 234 as the threaded lifting rod 1406 is rotated. The extending portion 234 is driven a pre-determined height and then pinned at that height via a cotter pin that slides through the main tube and extending portion. For lifting elements that have multiple extending portions, each telescoping portion is pinned through the surrounding tubes to hold them in their extended positions. The internal lifting element is driven upwards by a drive block which engages the thread of the threaded lifting rod 1406. Once the internal drive block has reached the top of the threaded lifting rod 1406, the extending portions of the vertical lifting elements 230 are pinned at that height and the internal drive block is lowered as the threaded lifting rod 1406 is reversed and lowers back to the bottom of the lifting element 230. There a different and second drive block reengages the threaded lifting rod 1406 and is again driven upward, repeating the lifting process. By having equal lengths of internal lifting element(s) in each vertical lifting element 230, ensures that all the vertical lifting elements 230 extend to an equal height with each lifting process. Thus the roof structure 102 does not get warped or broken and the weight stays evenly distributed across each of the vertical lifting elements. Each drive element 1400 is attached to a central driving control panel that ensures each drive element 1400 is driven the amount required to maintain the roof structure level and a controlled lift. There exist other lifting options available that can be used in this system, such as hydraulic pistons or jacks.

FIGS. 17A-17C is an exploded side view of non-metallic slider blocks 241 in the vertical lifting element 230. The vertical lifting element 230 is composed of an inner element 230A, a middle element 230B and a main element 230C. The non-metallic slider blocks 241 are secured in place by a projection that engages holes in the members of the telescoping vertical lifting element 230. The engagement holes on the various elements 230A, 230B and 230C are of two differing sizes to accommodate two differently sized non-metallic slider blocks 241A and 241B. The nonmetallic slider block 241A has a sliding surface diameter nearly the width of a face of the inner element 230A. The same slider block 241A is also disposed at an end of the element 230B that inner element 230A extends outwards from an opposite end of the element 230B, slider block 241B is disposed, having a diameter nearly the width of the face of the middle element 230B. Main element 230C has a slider block 241B disposed at an end. The non-metallic slider blocks align the elements 230A, 230B and 230C of the lifting element 230, which prevents the various elements from rubbing or twisting inside of each other during the lifting process. The outer shape of the non-metallic slider blocks 241 can be round, square, rectangular or a profile not here described. The shape of the projection on the non-metallic slider blocks 241 can be round, square, rectangular or a profile not here described. The non-metallic slider blocks are ideally made of a high molecular weight plastic having a low friction coefficient, but sufficient material strength to resist compression.

FIGS. 18A-18D is a cross sectional view of the non-metallic slider blocks 241 in the nested vertical lifting elements 230. The projections on the non-metallic slider blocks 241 are shown engaging holes in the members of the vertical lifting elements 230.

Figure 19A:
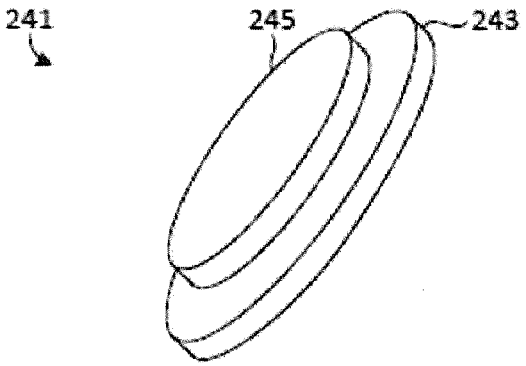
FIG. 19A is a perspective view of the non-metallic lifting block 241.
Figure 19B:
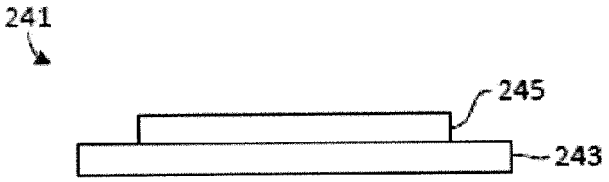
FIG. 19B is a side elevation view of the lifting block 241.
Figure 19C:
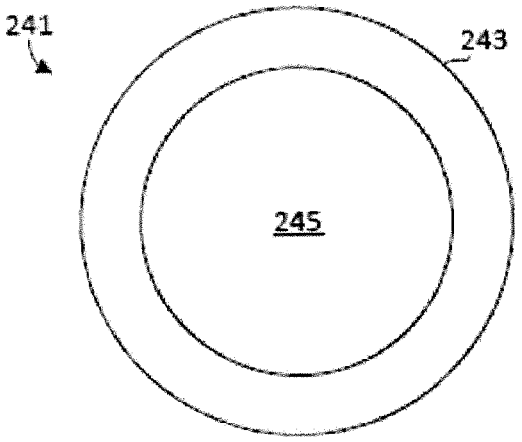
FIG. 19C is a top plan view of the lifting block 241.

FIG. 19A is a perspective view of a circular example of the non-metallic lifting block 241. The block has a large diameter 243 and a small diameter 245. The flat face of the large diameter 243 is the friction face that contacts a portion of the lifting element 230 as it slides. The small diameter 245 sits in holes in the lifting elements 230 and provides restraint to hold the nonmetallic slider block 241 in place on the lifting element. FIG. 19B is a side elevation view of the non-metallic slider block 241. FIG. 19C is a plan view of the non-metallic slider block 241.

FIG. 20A is a side view and FIG. 20B is a top view of the diagonal cross-brace outer tube and a separate 'lock pin block' item 258. The diagonal cross-braces 240 can utilize an internal ratcheting mechanism here defined as a 'lock pin block' item 258. The 'lock pin block' item 258 engages with the corresponding indentations of the inner tube of the diagonal cross-braces 240, as shown in section G-G. This allows the diagonal cross-braces 240 to be extended but does not allow the diagonal cross-braces 240 to be shortened until an external operation releases the ratchet mechanism or 'lock pin block' item 258. The release of the 'lock pin block' item 258 enables the inner tubes of the cross-brace to retract back into the outer body tube of the cross-brace 240. The spring loaded index plunger, as shown in FIG. 20A, is an example device that may be used to index and restrain an object, in this case, the removable 'lock pin block' 258.

Figure 21:
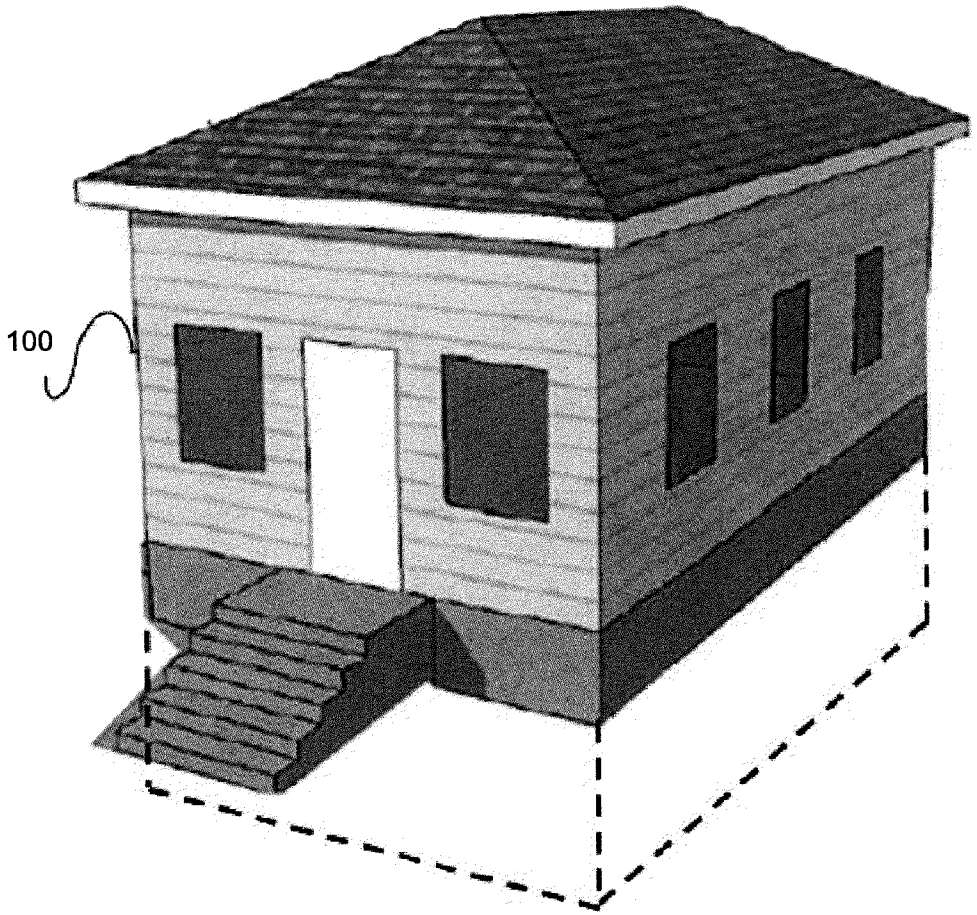
FIGS. 21 and 22 are conceptual drawings showing in perspective view the steps of raising an entire building with a jacking system for repair or replacement of sill plates, supporting walls, and or footings, using a jacking system according to an embodiment of the invention.

FIG. 21 shows a complete structure 100 which may be lifted for repair or replacement of sill plates, supporting walls, footings and other structural features. Additionally, the building may be lifted to add an additional level(s) to the structure. In a further embodiment, the structure may be lifted and the roof structure may be, simultaneously or separately, lifted to accomplish the desired construction tasks.

Figure 22:
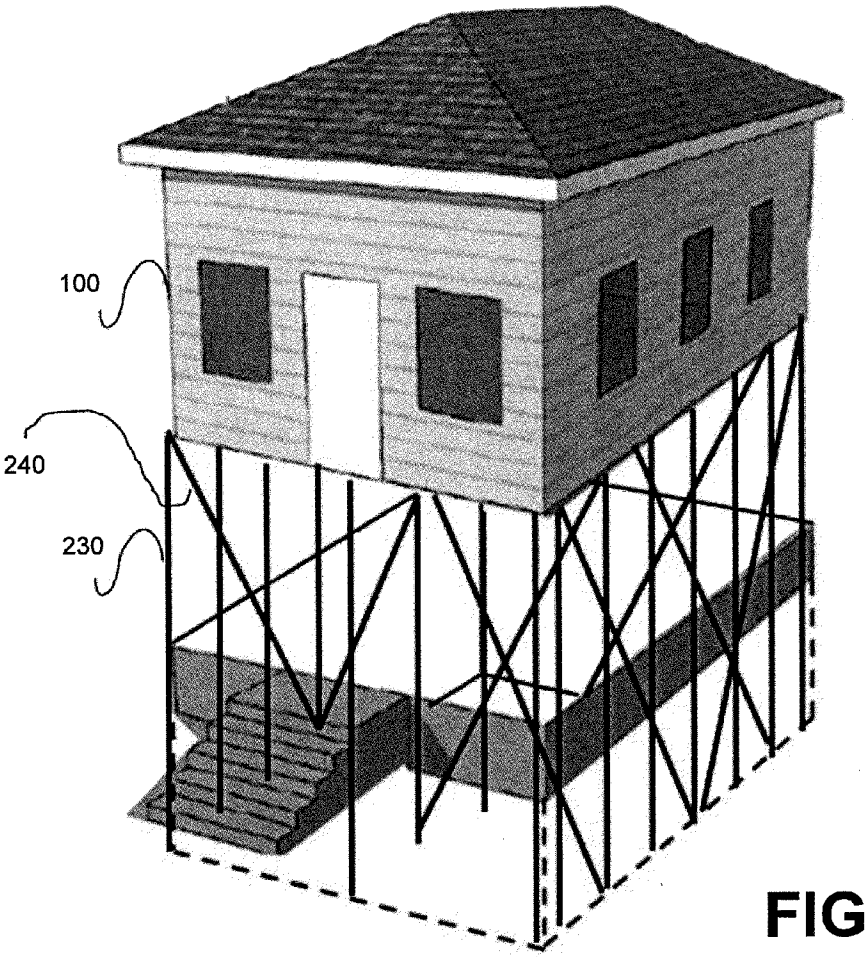

FIG. 22 shows the structure of FIG. 21 raised with the telescoping wall jacks 230, with diagonal braces 240, installed to avoid wracking.

Figure 23:
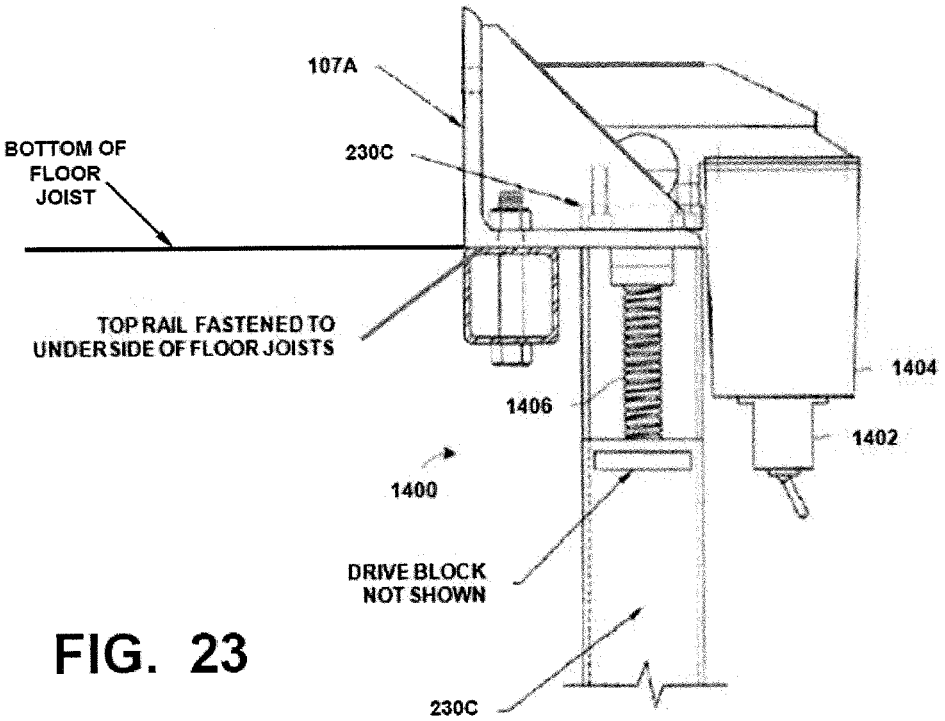
FIG. 23 is an enlarged side elevation view of the drive element 1400 located between the floor joists for lifting an entire building.
Figure 24:
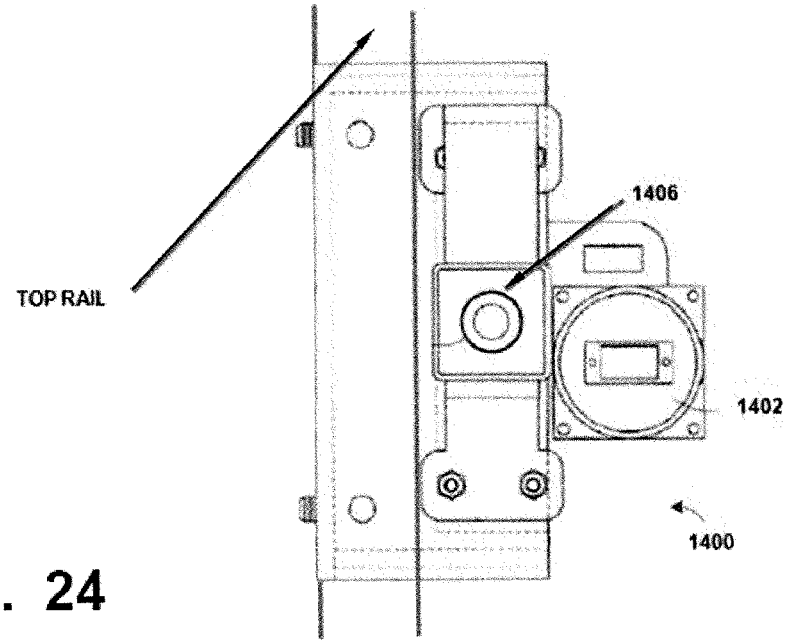
FIG. 24 is a cross-sectional view of the drive element 1400 of FIG. 23.

FIG. 23 shows a detailed side view of the drive element 1400 and bracket 107A. FIG. 24 shows a detailed top view of the drive element 1400 of FIG. 23. The drive element 1400 has a drive motor 1402 that is attached to the drive gear box 1404 that drives a self-locking Acme threaded rod 1406. Each vertical lifting element 230 has a drive block attached to the threaded rod 1406 that lowers the extending portion 234 as the threaded lifting rod 1406 is rotated. The extending portion 234 is driven a pre-determined length by an internal drive block and then pinned via a cotter pin that slides through the main tube and extending portion. For lifting elements that have multiple extending portions, each telescoping portion is pinned through the surrounding tubes to hold them in their extended positions. The internal lifting element is driven downwards by a drive block which engages with the threads of the threaded rod 1406. Once the internal drive block has reached the end of the threaded lifting rod 1406, the extending portions of the vertical lifting elements 230 are pinned. The internal drive block is returned to an initial position as the threaded rod 1406 is reversed. Once the drive block is returned, a different and second drive block is inserted and reengages the threaded rod 1406. The new drive block is driven downward, repeating the lifting process. Having equal lengths of internal lifting element(s) in each vertical lifting element 230 ensures that all the vertical lifting elements 230 extend an equal length with each lifting process. In doing so, the building structure 100 does not get warped or damaged since the weight stays evenly distributed across each of the vertical lifting elements. There exist other lifting options available that can be used in this system, such as hydraulic pistons or jacks.

Each drive element 1400 is attached to a central driving control panel that ensures each drive element 1400 is driven, either independently or in unison, such that structure remains level and lift is controlled. An example control means could include monitoring of the amperage drawn by each drive element 1400. A method of monitoring the amperage drawn by each of the drive elements 140 can be an ammeter attached to each drive element. The amperage drawn by each drive element 1400 is correlated to the amount of torque each drive element 1400 is exerting to lift the structure. Should the amount of amperage drawn by a drive element 1400 spike, it can be indicative of unequal loading which could mean that the load is now unbalanced or proceeding at unequal rates. The controller can vary the amount of power and lift rate of each of the drive elements 1400 to rebalance and relevel the structure.

Alternative control and measurement systems can be used, such as load cells on each drive element, voltage monitoring of the drive elements 1400 and/or the system as a whole or others, level and/or alignment sensors on the jacks and/or structure, or some combination thereof. An example alignment sensor system is a system of sensors that relay the relative position and/or extension length of a wall jack member in relation to the other wall jack members. Aligning the lifting of each of the wall jack members lifts the structure in a stable and balanced state as desired.

Figure 25B:
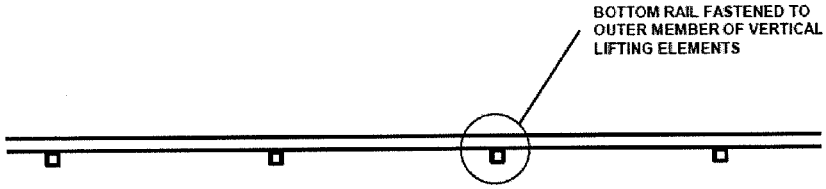
FIG. 25B is a plan view of the bottom rail.
Figure 25A:
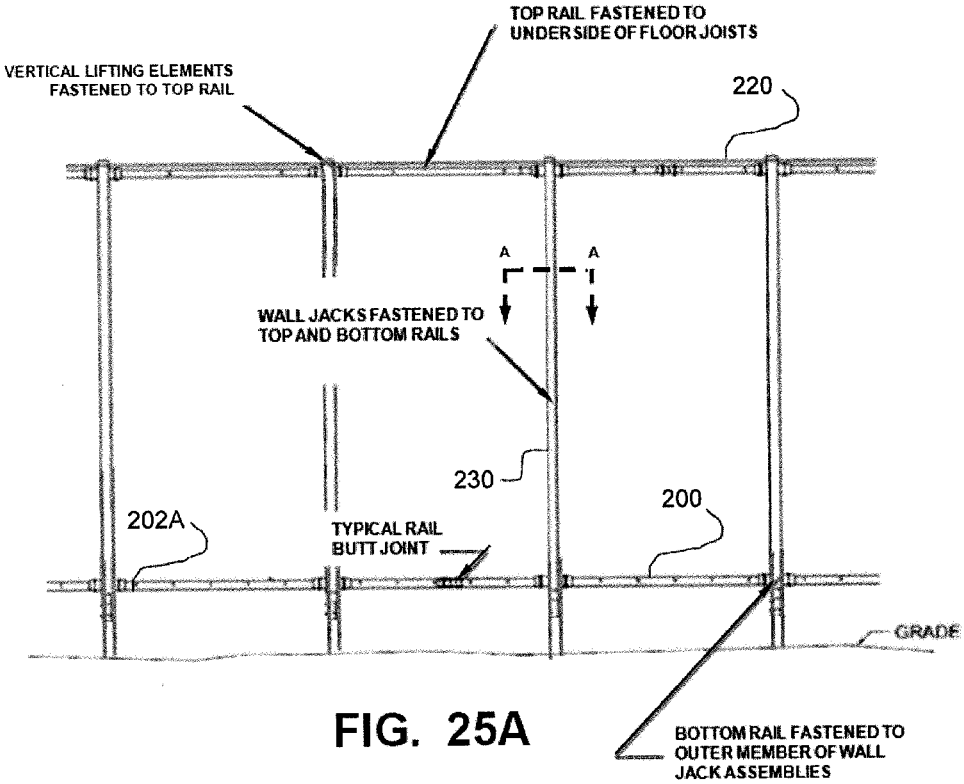
FIG. 25A is a side elevation view of the jacking system showing upper and bottom horizontal rails in preparation of securing diagonal bracing and lifting an entire building.

FIG. 25A is a schematic side elevation showing details of the lifting system attached to the structure 100. The top lifting rail 220 is attached to the structure 100 at the underside of the floor joists as also previously shown in FIG. 23. The bottom lifting rail 200 has holes 202 spaced regularly along the length of the rail 200. Section A-A is identified to further define method of attachment of the bottom rail 200.

FIG. 25B is a schematic top view of the lifting system and identifies that both top lifting rail 230 and bottom rail 200 are attached to the same side of the outer element 230C of the vertical lifting elements 230.

Figure 25C:
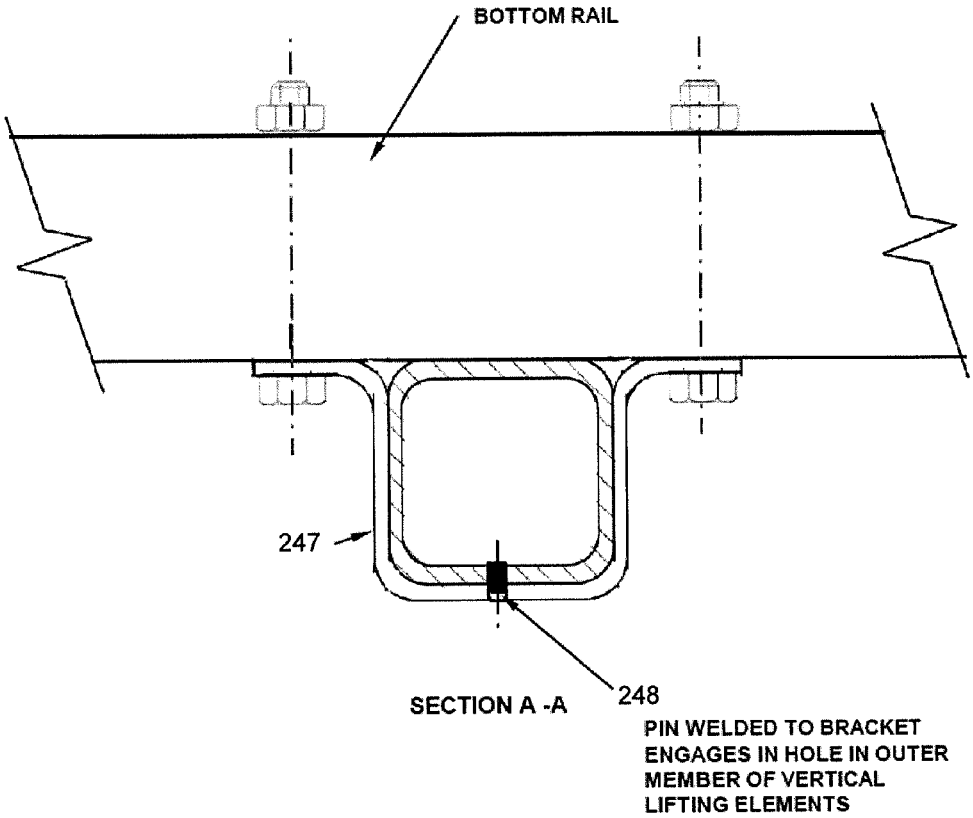
FIG. 25C is an enlarged view of FIG. 25B showing the interconnection to the vertical lifting element.

FIG. 25C shows cross Section A-A identifying bracket 247 has an integral locating pin 248 that engages in a hole in the outer element 230C of the vertical lifting elements 230. Hardware connects bracket 247 to the bottom rail 200 through holes 202A, thereby rigidly linking the vertical lifting elements 230 together with top rail 220. Multiple bottom rail elements 200 are interconnected to form a rigid framework that links together predetermined vertical lifting element assemblies 230 and acts as the lower structure of the lifting system. The bottom rail elements 200 are connected to one another using a butt joint 910. The rails 200 have holes 202A at each end. The butt joint 910 is inserted inside the end of a rail 200 and is locked in place by inserting retaining pins in the end holes 202A and through the holes on the butt joint. The end holes 202A are spaced to ensure that the spacing of the holes 202 is maintained across the interconnection at the butt joint 910.

Figure 26:
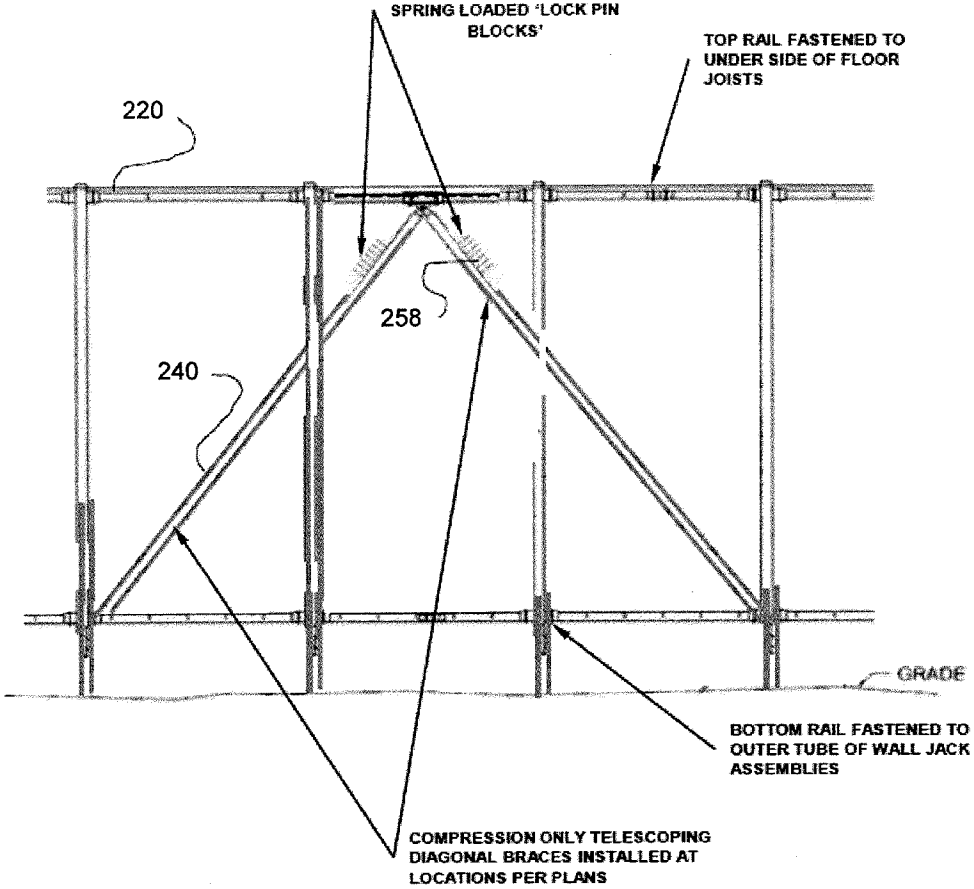
FIG. 26 is a side elevation view of the jacking system showing diagonal bracing secured to upper and bottom horizontal rails in preparation of and lifting an entire building.

FIG. 26 shows a detailed method of applying extendible cross-braces 240 between 'pairs' of wall jacks 230 to provide lateral stability of lifted structure. The spacing of the wall jacks 230 and cross-braces 240 provides sufficient space to accomplish the desired construction steps. With the structure raised, workers can excavate, prep and pour new footings and foundation walls and or add an additional level(s) under the original level. The 'lock pin block' item 242 is shown on each extendible cross-braces 240.

Figure 27:
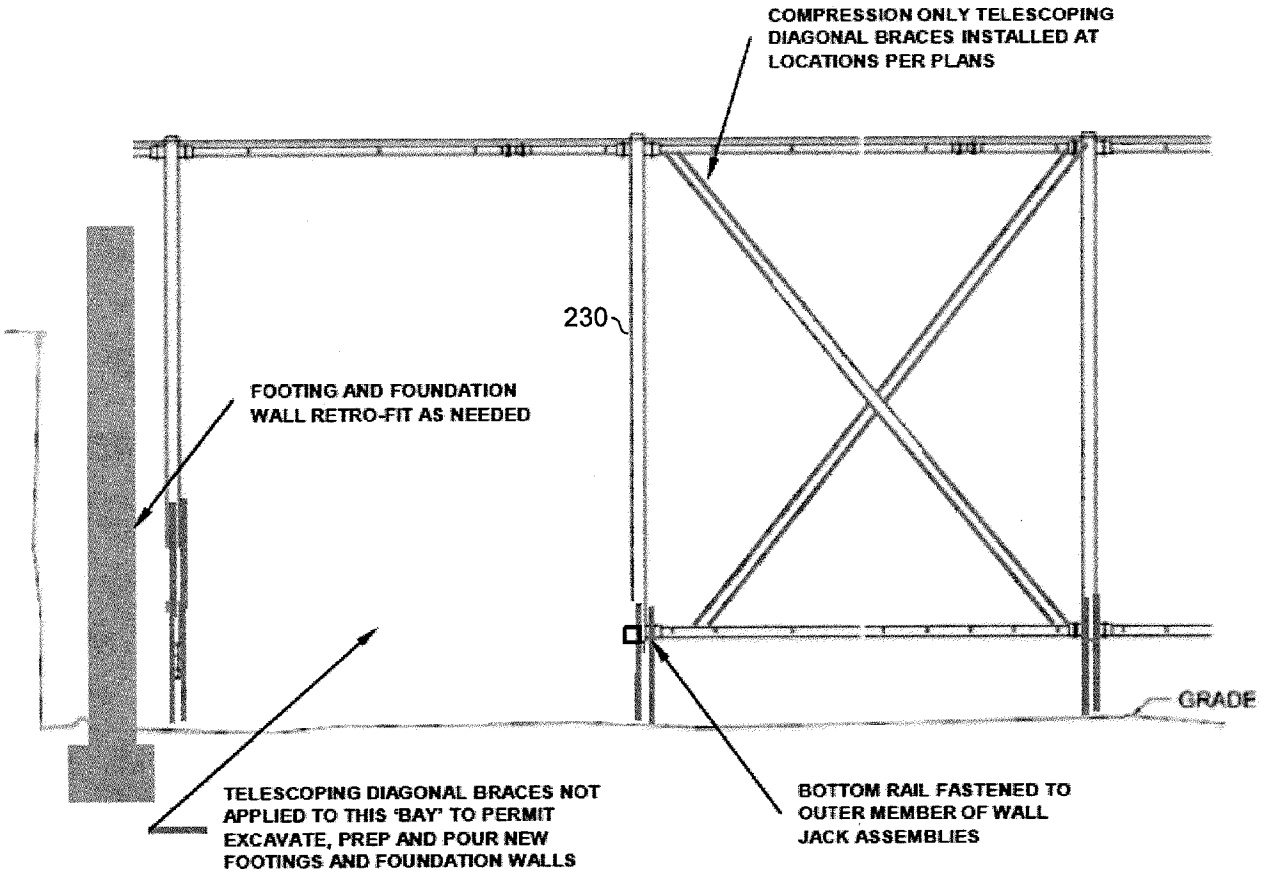
FIG. 27 is a side elevation view showing placement of diagonal bracing to provide lateral stability of lifted structure while at same time providing sufficient space to excavate, prep and pour new footings and foundation walls.

FIG. 27 shows a detailed method of applying extendible cross-braces 240 between predetermined 'pairs' of wall jacks 230 to provide lateral stability of lifted structure while providing access required to excavate, prep and pour new footings and foundation walls.

The vertical lifting elements 230 are attached at regular or irregular intervals around each side of the house, and other predetermined locations to interconnect the rails 200, and 220. Elements 230 are affixed to each rail using the holes 202 disposed on each rail. The system of holes on each rail allows for the quick attachment and removal of the lifting elements 230. Additionally, the vertically-aligned pattern of holes makes it easy for someone installing the lifting elements 230 to space them properly and position them vertically around the periphery or other predetermined locations.

Figure 28:
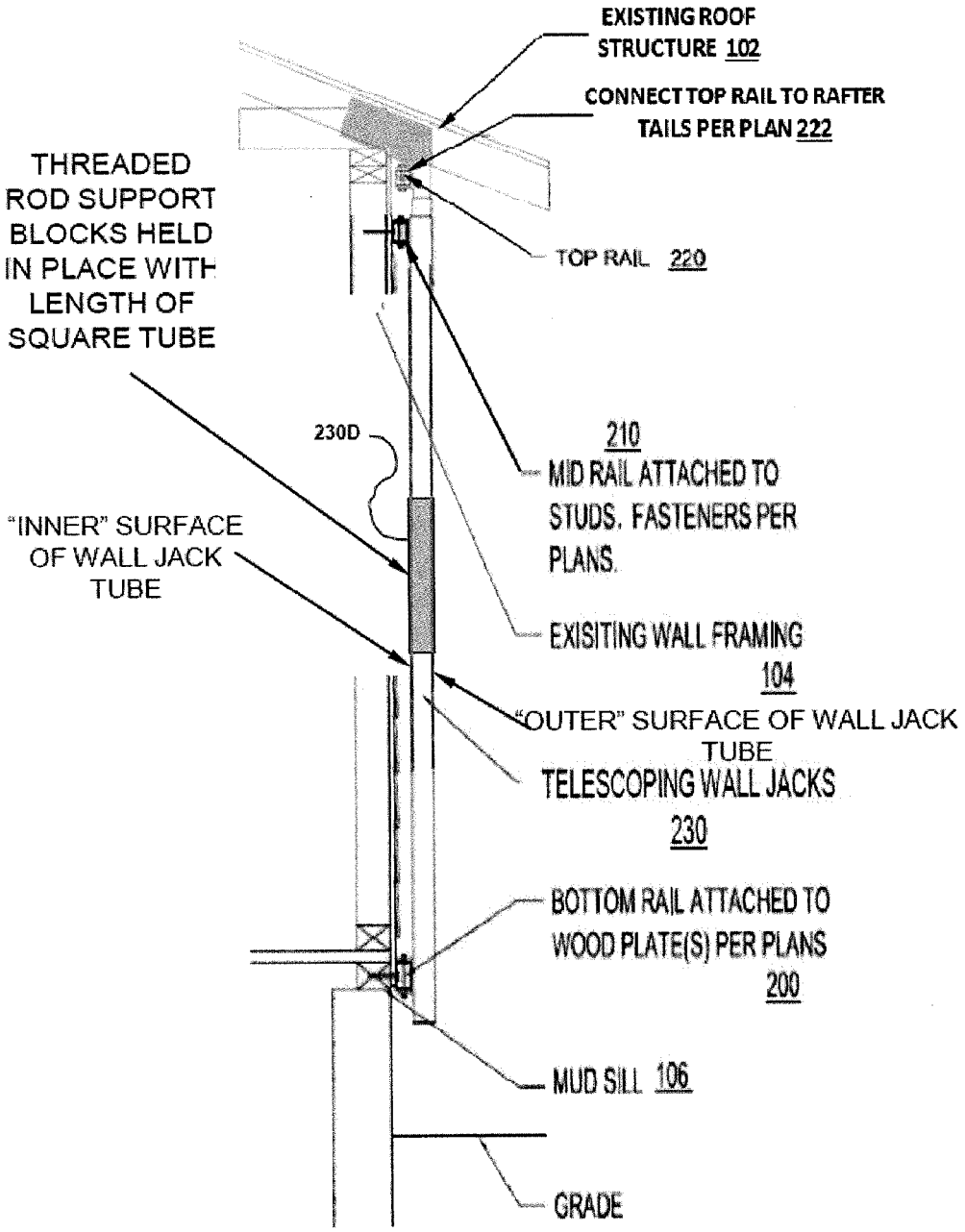
FIG. 28 is a cross sectional view showing general location of threaded rod support blocks for the jacking system when raising either a roof structure or raising an entire building.

FIG. 28 shows a detailed schematic view of a wall cross-section showing the detail of the method using the tube 230D to provide and retain replaceable threaded rod supports 249 thereby limiting deflection due to the applied vertical load when lifting either a roof structure or an entire building.

Figure 29:
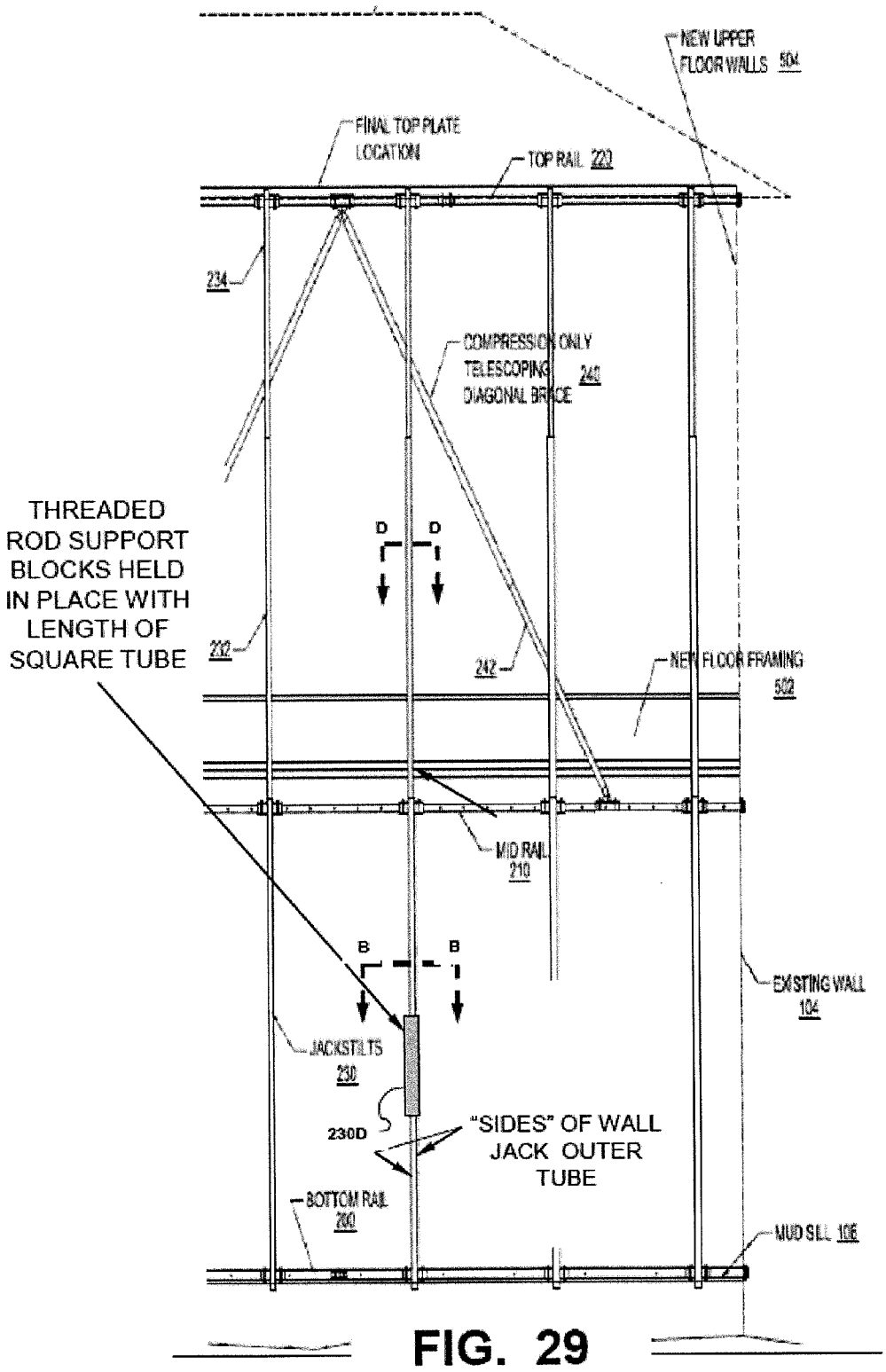
FIG. 29 is side elevation view showing general location of threaded rod support blocks for the jacking system when raising either a roof structure or a complete structure as shown in FIG. 25A.

FIG. 29 shows a detailed schematic side view of a structure with Section B-B and Section D-D identified to show the detail of the method to provide and retain replaceable threaded rod supports 249 using the tube 230D.

Figure 30A:
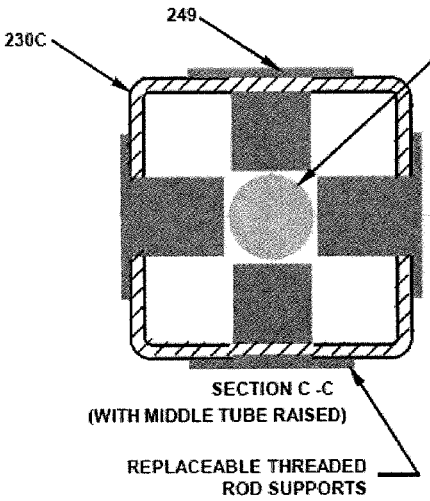
FIGS. 30A-30D are cross sectional views of a vertical lifting jack assembly showing the threaded rod support blocks at various sections in FIG. 29.

FIG. 30A shows a detailed cross Section C-C of outer element 230C of lifting element 230 showing detail of the method to provide replaceable threaded rod supports 249. Location where cross Section C-C is taken is shown in FIG. 32B. Location where cross Section C-C is taken is shown in FIG. 32B with the middle element in the raised position when lifting a roof structure, and the middle element in the lowered position when lifting an entire structure.

Figure 30B:
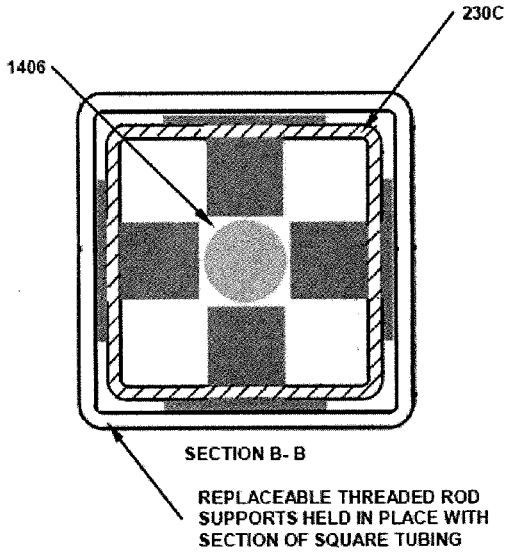

FIG. 30B shows a detailed cross Section B-B of outer element 230C of lifting element 230 showing the detail of the method to provide and retain replaceable threaded rod supports 249. Location where cross Section B-B is taken is shown in FIG. 29.

Figure 30C:
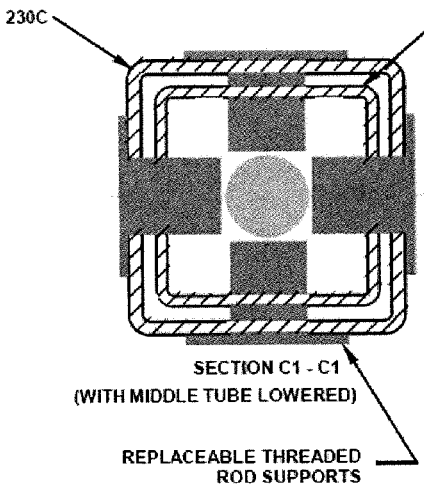

FIG. 30C shows a detailed cross Section C1-C1 of outer element 230C and middle element 230B of lifting element 230 showing detail of the method to provide replaceable threaded rod supports 249. Location where cross Section C1-C1 is taken is shown in FIG. 32B with the middle element in the lowered position when lifting a roof structure, and in the middle element in the raised position when lifting an entire structure.

Figure 30D:
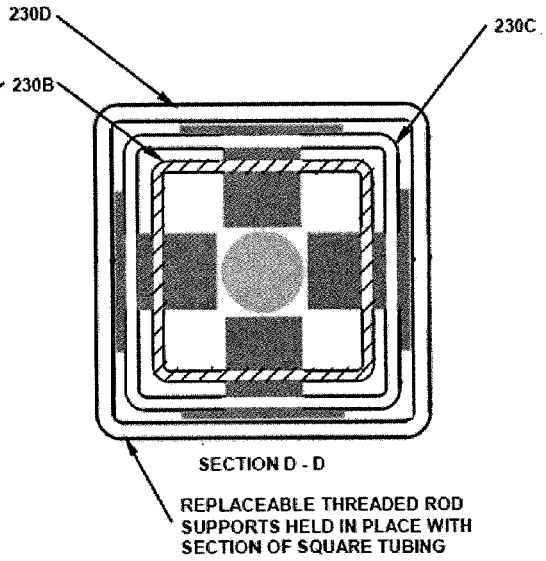

FIG. 30D shows a detailed cross Section D-D of middle element 230B of lifting element 230 showing detail of the method to provide replaceable threaded rod supports 249. Location where cross Section D-D is taken is shown in FIG. 29 with the middle element 230B in the raised position when lifting a roof structure, and the middle element 230B in the lowered position when lifting an entire structure.

A drive block attached is to the threaded lifting rod 1406 that elevates the extending portion 234B when raising a roof structure or pushes downward extending portion 234B when raising an entire structure as the threaded lifting rod 1406 is rotated. The extending portion 234B is driven a pre-determined distance and then pinned at that location via a cotter pin that slides through the main tube and extending portion. After the inner extending portion 234B is pinned, replaceable threaded rod supports 249 are installed through holes in outer tube 230C of lifting element assembly 230. A length of tubing 230D is utilized to secure and retain replaceable threaded rod supports 249. One or more than one set of replaceable threaded rod supports 249 and section of tube 240D may be used per lifting element assembly 230.

Figure 31A:
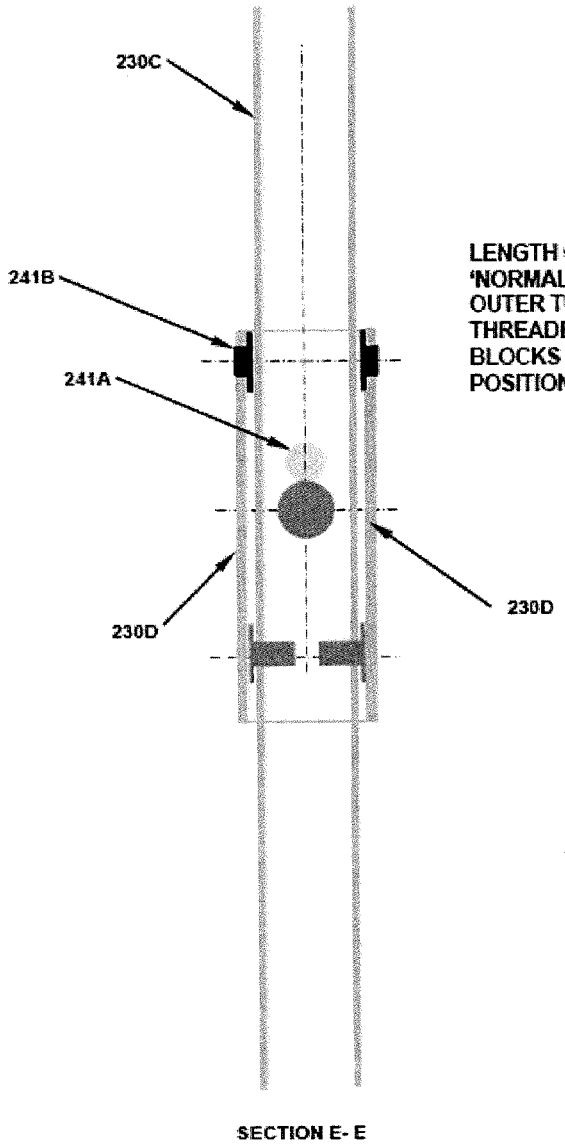
FIGS. 31A-31B show transverse sectional views of the tubing section in its normal location to keep the threaded rod support blocks in place.
Figure 31B:
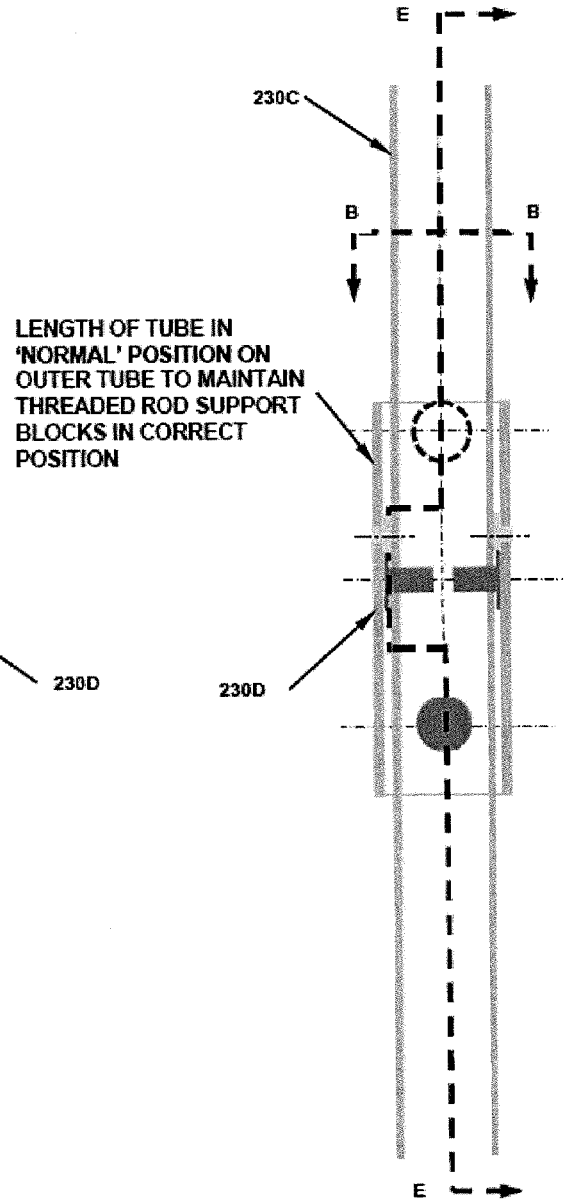

FIG. 31A shows detailed cross Section E-E of lifting element assembly 230 showing the detail of the method to retain the replaceable threaded rod supports 249 with section of tubing 230D in its normal position. Two differently sized non-metallic slider blocks 241A and 241B are inserted in holes in tube section 240D, and make contact with replaceable threaded rod supports 249, thereby serving as a 'stop' and limits the vertical travel of tube section 240D. FIG. 31B is a detailed cross section of lifting element assembly 230 showing the detail of the method to retain the replaceable threaded rod supports 249 with section of tubing 230D in its normal position. FIG. 31B identifies where Section E-E is taken.

Figure 32A:
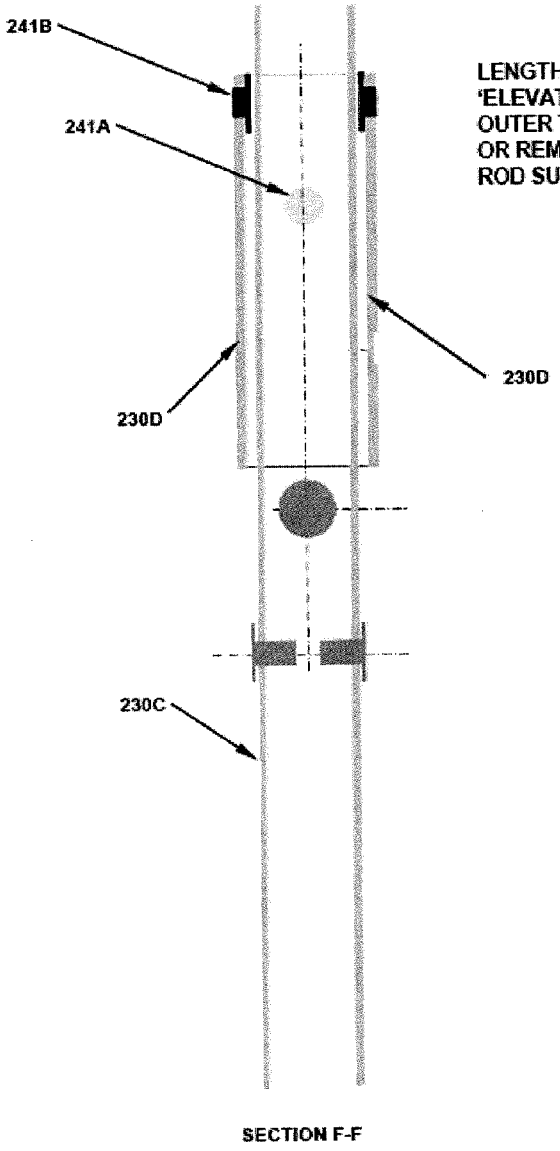
FIGS. 32A-32B show transverse sectional views of the tubing section in its raised position to either install or replace the threaded rod support blocks.
Figure 32B:
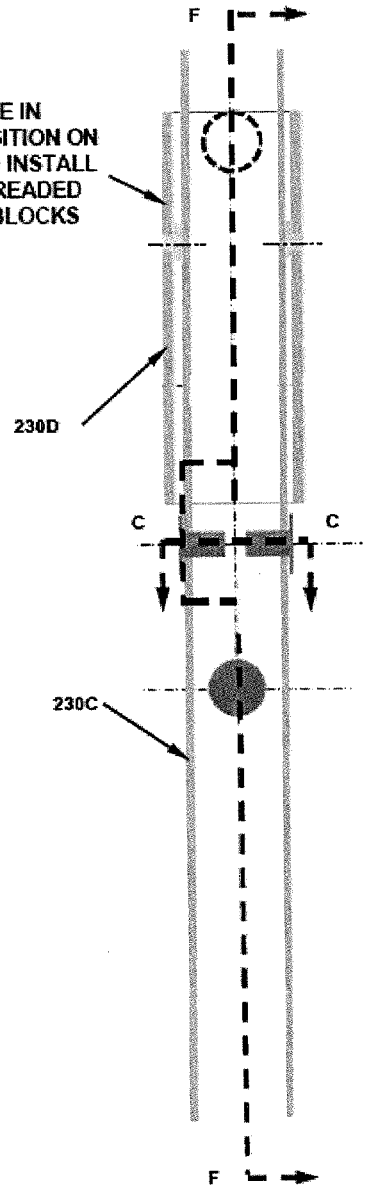

FIG. 32A shows detailed cross Section F-F of lifting element assembly 230 with section of tubing 230D in its raised position to install or replace replaceable threaded rod supports 249. FIG. 32B identifies where Section F-F is taken.

The various elements of this apparatus can be made of steel or other suitable materials. These can include aluminum and other metals. Selection of materials is based on the likely loads each element would encounter during the lifting process. In this manner, certain materials can be chosen for their compressive or tensile strength and weight. Composite materials can also be used; the lightweight and high strength of these materials may be optimal, but must be weighed against the cost of manufacturing the various elements. Additionally, each element of this apparatus is reusable, making this system easy to install and remove on multiple building sites. Due to the modular nature of this system, it can be expanded to fit a building of many sizes.

Having described and illustrated the principles of the disclosed technology in a preferred embodiment thereof, it should be apparent that the disclosed technology can be modified in arrangement and detail without departing from such principles. We claim all modifications and variations coming within the spirit and scope of the following claims

The invention claimed is:

1. A method for raising a structure, the method comprising:

fastening a top rail horizontally along an underside of a plurality of floor joists of the structure;

coupling a plurality of vertical jack members to the top rail, fastening a bottom rail horizontally to an outer tube of each of the plurality of vertical jack member near the ground or floor under the structure;

coupling at least one of a plurality of cross-braces to the top rail and the bottom rail, the cross brace connected at a first end to the top rail and a second end to the bottom rail, the cross-brace having a retention mechanism configured to allow the cross-brace to extend in a ratcheting manner; and extending a lower end of the vertical jack member to raise the top rail and structure coupled thereto.

2. A method according to claim 1, wherein the cross-brace retention mechanism comprises spring loaded plungers mounted to an outer tube of the cross-brace, the spring loaded plungers configured to engage with an indented surface of an inner tube.

3. A method according to claim 1, wherein each of the plurality of vertical jack member comprises an inner portion and an outer portion, the outer portion connected to the bottom rail and the inner portion attached to the top rail.

4. A method according to claim 1, further comprising a powered drive gear box configured to extend the lower end of each of the plurality of vertical jack member and positioned between the floor joists.

5. A method for raising a roof structure of a building for installation of a next floor structure and walls for an added story, the method comprising:

fastening a bottom rail horizontally along a foundation or sill of the building;

fastening a mid-rail horizontally along an upper structural element of a wall of the building;

fastening a top rail horizontally along a structural element of a roof of the building;

coupling at least two vertical wall jack members to the bottom rail, to the mid rail, and the top rail;

coupling telescoping diagonal cross-braces each at a first end to the mid rail and each at a second end to the top rail, the telescoping diagonal cross-braces having capability to extend but not retract thereby providing lateral support to the existing roof and wall structure during the lifting process where the roof and walls have no structural connection to each other; and extending an upper end of the vertical wall jack member to raise the top rail and the structural element of the roof coupled thereto.

6. A method according to claim 5 for the diagonal braces to extend but not retract by utilizing spring loaded plungers mounted to the outer tube of the diagonal braces to engage and lock sequentially in indented surfaces of the inner tube thereby providing required lateral stability for the roof structure necessary to achieve local and national code compliance for the lifting system.

7. A method according to claim 5 including removing the spring loaded plungers of a lock pin block on the diagonal cross-braces to efficiently allow the diagonal cross-braces to be retracted when ready to lower the roof structure onto the new wall sections.

8. A method of raising a structure, comprising:

fastening a first rail horizontally about a first portion of the structure;

fastening a second rail horizontally about a second portion of the structure, the second portion of the structure disposed below the first portion of the structure and separated therefrom;

coupling a plurality of jack members between the first rail and the second rail, including:

coupling a top portion of each vertical jack member to the first rail;

coupling a lower portion of each vertical jack member to the second rail;

coupling a pair of cross-braces to the first and second rails, each cross-brace having a first end connected to the first rail and a second end connected to the second rail, each cross-brace extensible and having a locking ratchet mechanism to prevent retraction of the cross-brace; and extending the lower portion of each vertical jack member to raise the first rail and the attached first portion of the structure.

9. A method of raising a structure according to claim 8, including mounting the ratchet mechanism to an outer tube of a cross-brace and including a plurality of spring loaded plungers configured to engage with indentations on the surface of an inner tube of the cross-brace.

10. A method of raising a structure according to claim 8, further coupling a powered drive gear box to each vertical jack member, the powered drive gear box configured to extend the lower portion of the coupled vertical jack member.

* * * * *